United States Patent [19]

Bittmann et al.

[11] Patent Number: 4,915,620

[45] Date of Patent: Apr. 10, 1990

[54] BURNER, IN PARTICULAR ATMOSPHERIC PRE-MIX GAS BURNER, AND COOLING RODS THEREFOR

[75] Inventors: Bernd Bittmann, Wermelskirchen; Donald Hellmann, Iserlohn; Kurt Pelzer, Kürten-Weiden; Thomas Pieper, Wermelskirchen; Jürgen Tenhumberg, Radevormwald; Horst J. Schilling, Wermelskirchen, all of Fed. Rep. of Germany

[73] Assignee: Joh. Vaillant GmbH & Co., Remscheid, Fed. Rep. of Germany

[21] Appl. No.: 138,491

[22] Filed: Aug. 20, 1987

[30] Foreign Application Priority Data

| | | | |
|---|---|---|---|
| Oct. 5, 1985 | [DE] | Fed. Rep. of Germany | 3535937 |
| Dec. 23, 1985 | [AT] | Austria | 3719/85 |
| Feb. 25, 1986 | [DE] | Fed. Rep. of Germany | 8605042 |
| Jun. 27, 1986 | [AT] | Austria | 1752/86 |
| Aug. 18, 1986 | [DE] | Fed. Rep. of Germany | 8622113 |
| Aug. 26, 1986 | [DE] | Fed. Rep. of Germany | 8622799 |
| Aug. 28, 1986 | [DE] | Fed. Rep. of Germany | 8623133 |

[51] Int. Cl.[4] ..... F23D 14/12

[52] U.S. Cl. ..... 431/347

[58] Field of Search ..... 431/347

[56] References Cited

U.S. PATENT DOCUMENTS

| | | | |
|---|---|---|---|
| 2,379,524 | 7/1945 | Hobson | 431/347 |
| 2,808,047 | 10/1957 | Jaye et al. | 126/110 R |
| 4,285,666 | 8/1981 | Burton et al. | 431/347 |
| 4,525,141 | 6/1985 | DeWerth et al. | 431/347 |
| 4,616,994 | 10/1986 | Tomlinson | 431/347 |
| 4,629,415 | 12/1986 | DeWerth et al. | 431/347 |

FOREIGN PATENT DOCUMENTS

| | | | |
|---|---|---|---|
| 1232596 | 5/1971 | United Kingdom | 431/347 |

*Primary Examiner*—Carroll B. Dority
*Attorney, Agent, or Firm*—Horst M. Kasper

[57] ABSTRACT

Cooling rods (2) take away the heat from the flame area of a burner (1). Various embodiments of supports (4) for these cooling rods (2) are disclosed.

24 Claims, 31 Drawing Sheets

FIG. 1
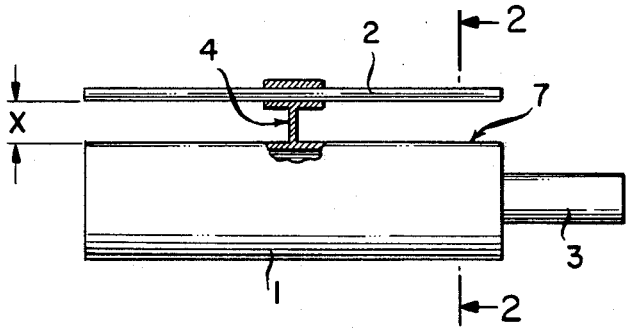
FIG. 2
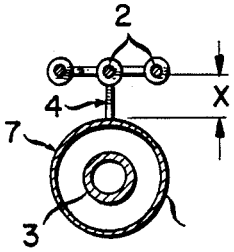
FIG. 3
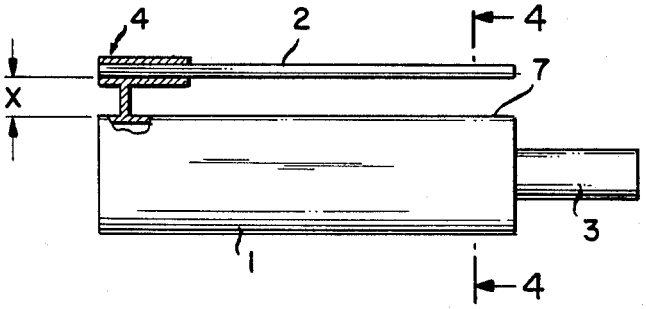
FIG. 4
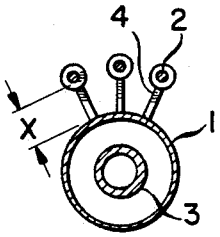
FIG. 5
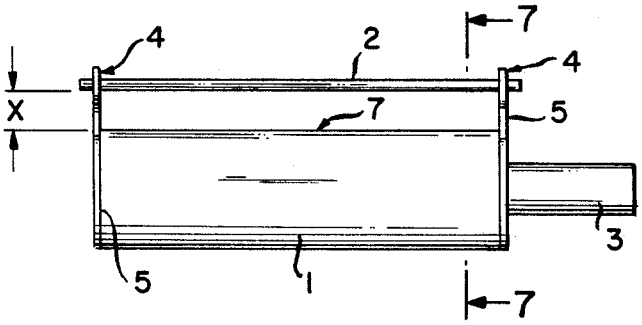
FIG. 6
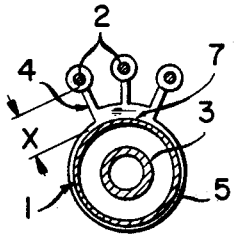
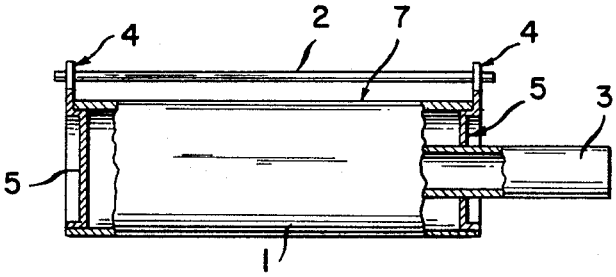
FIG. 11

FIG. 26
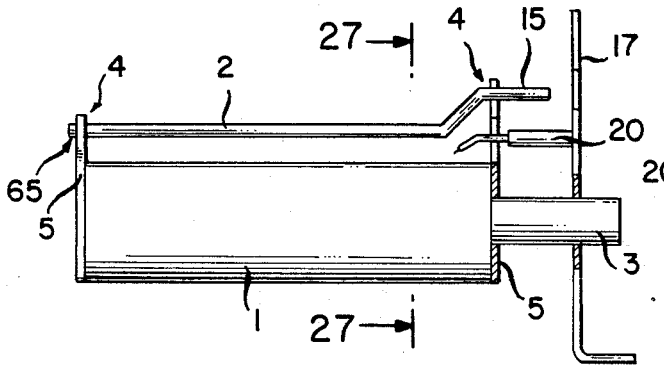
FIG. 27
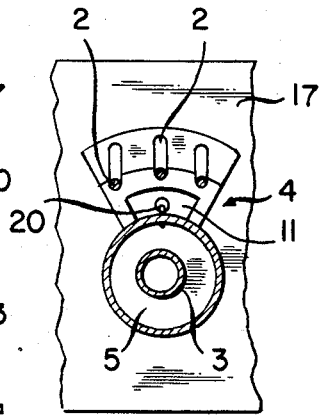
FIG. 28
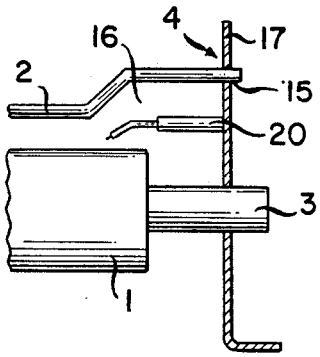
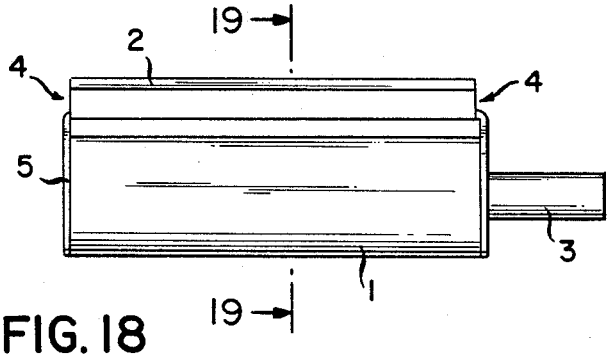
FIG. 18
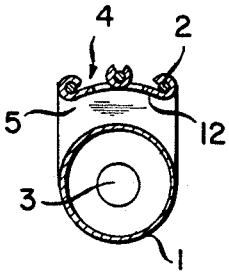
FIG. 19

FIG. 22
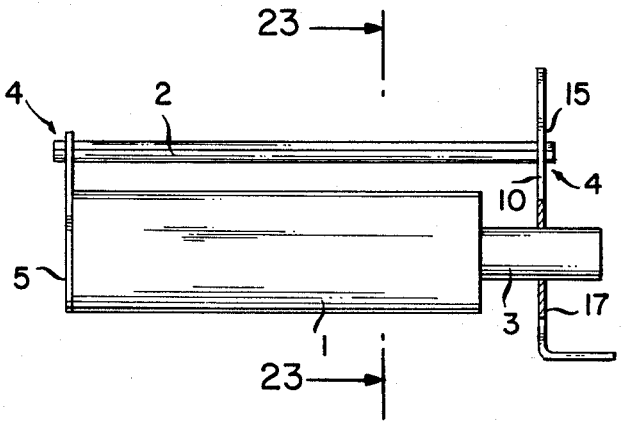
FIG. 23
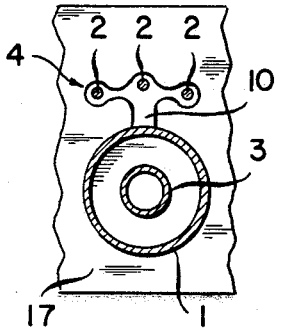
FIG. 24
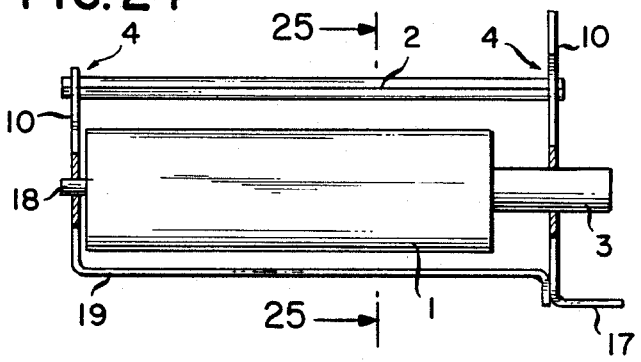
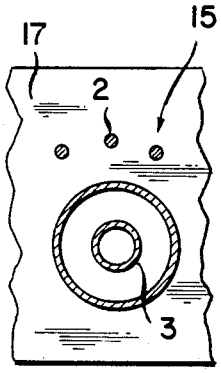
FIG. 25
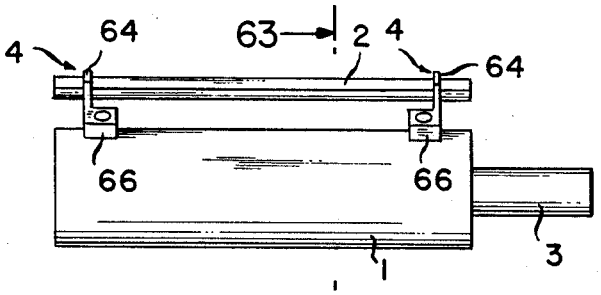
FIG. 62
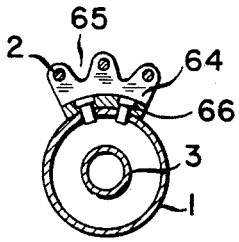
FIG. 63

FIG. 29
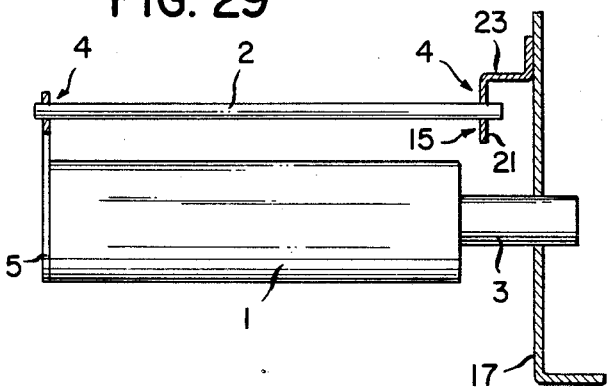
FIG. 30
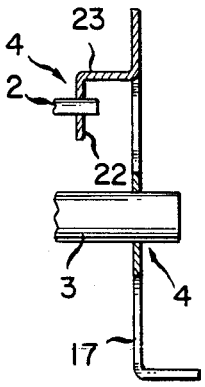
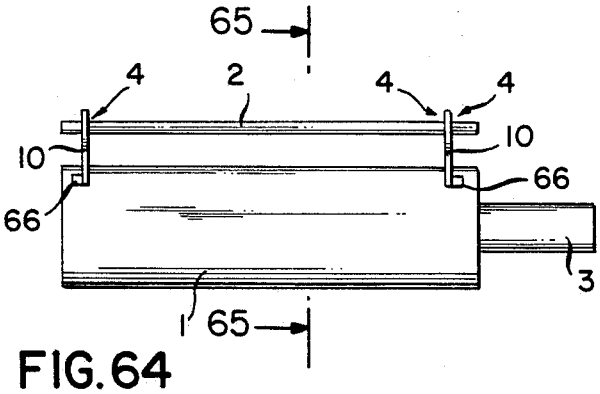
FIG. 64
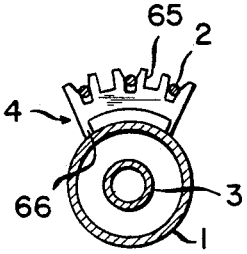
FIG. 65
FIG. 31
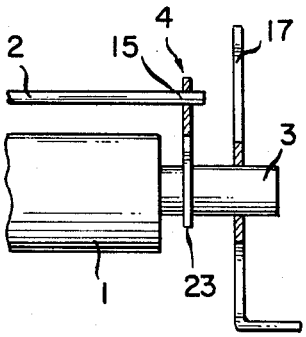

FIG. 32
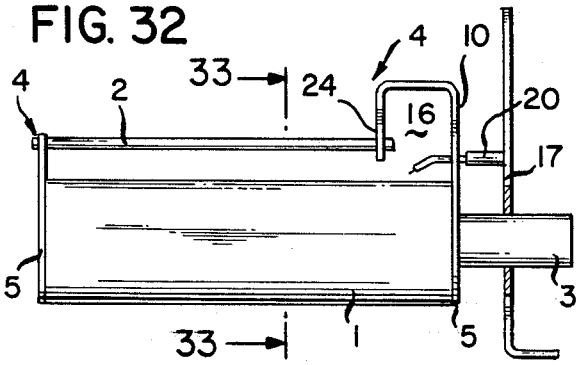
FIG. 33
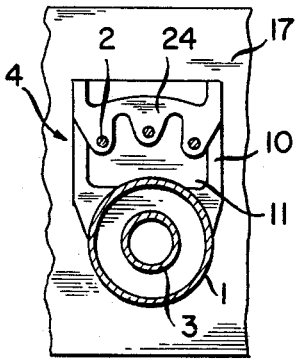
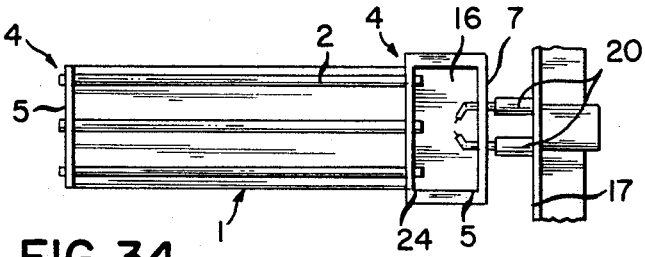
FIG. 34
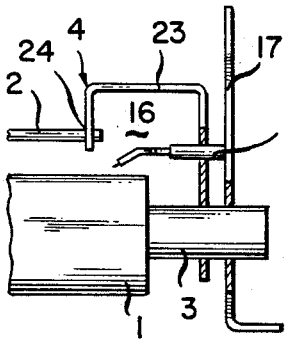
FIG. 35
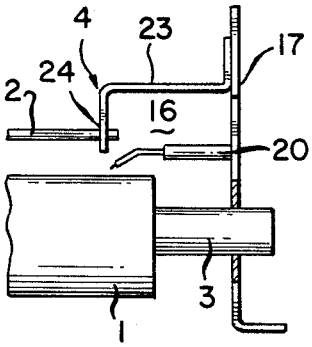
FIG. 36

FIG. 37
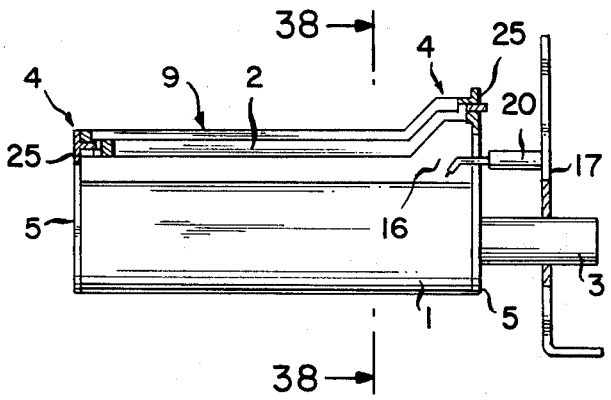
FIG. 38
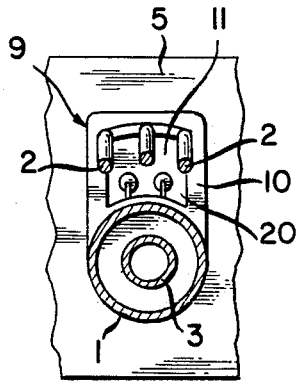
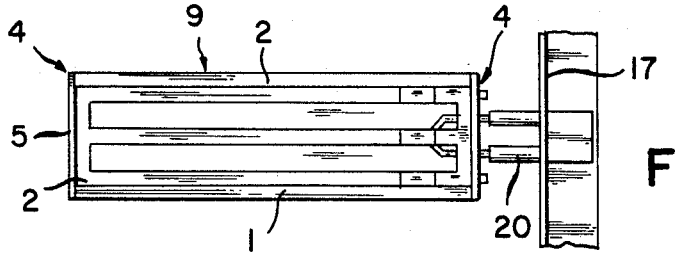
FIG. 39
FIG. 40
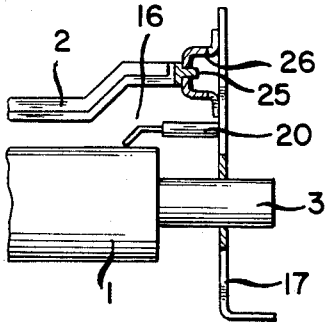

FIG. 41
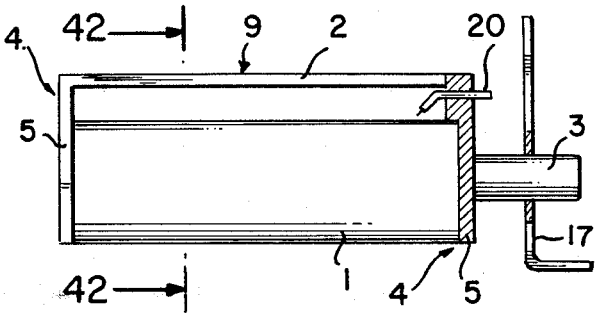
FIG. 42
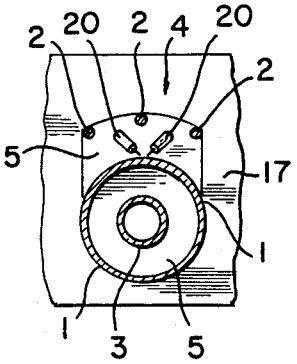
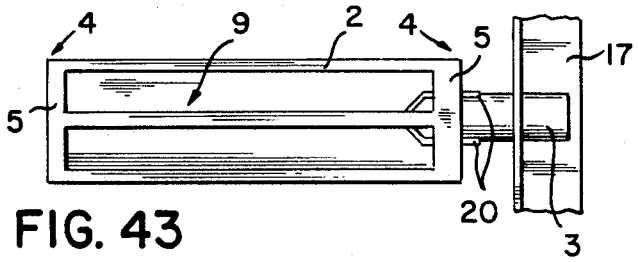
FIG. 43
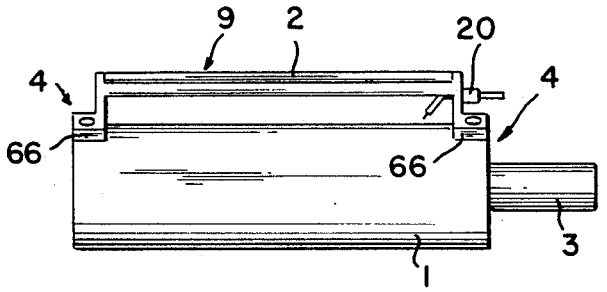
FIG. 66
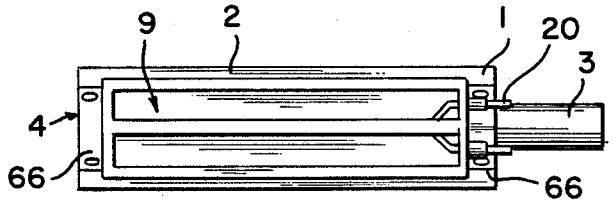
FIG. 67

FIG. 44
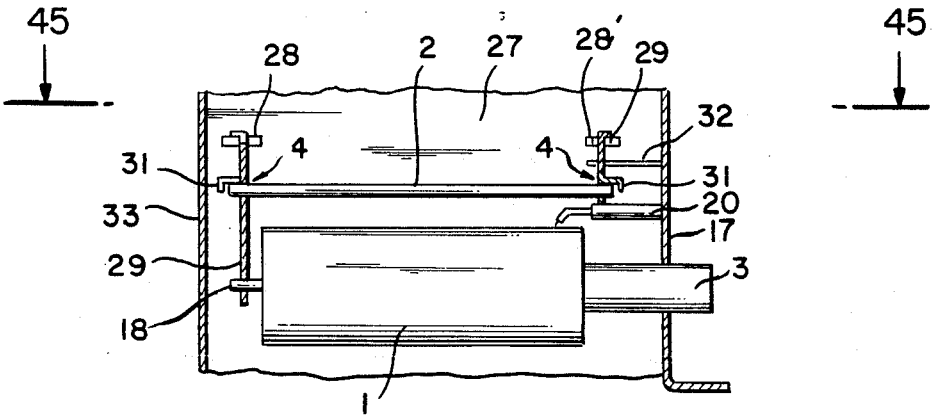
FIG. 45
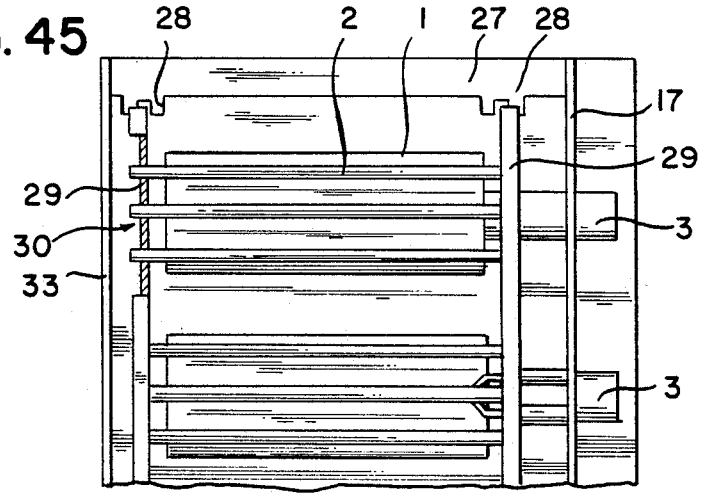
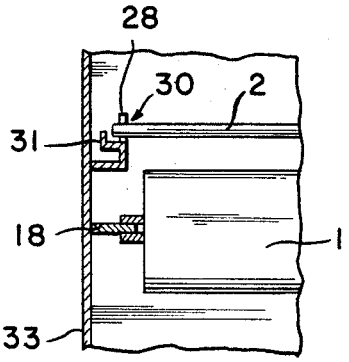
FIG. 46

FIG. 56
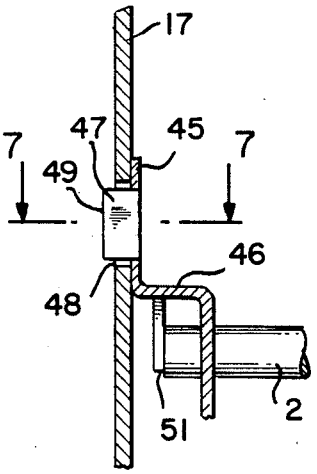
FIG. 55
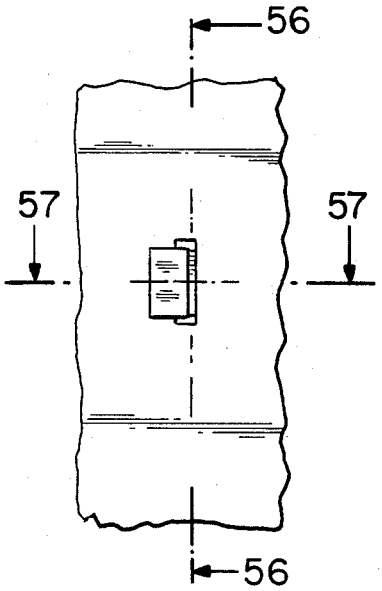
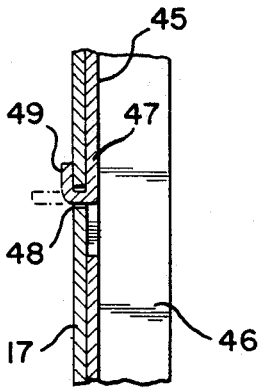
FIG. 57

FIG. 58
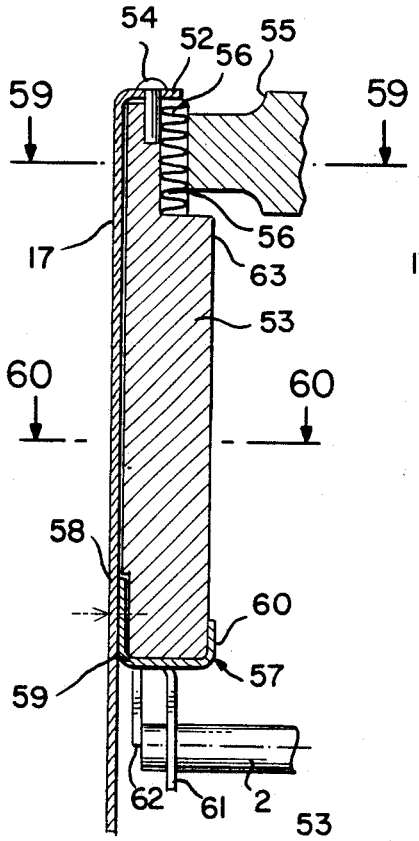
FIG. 59
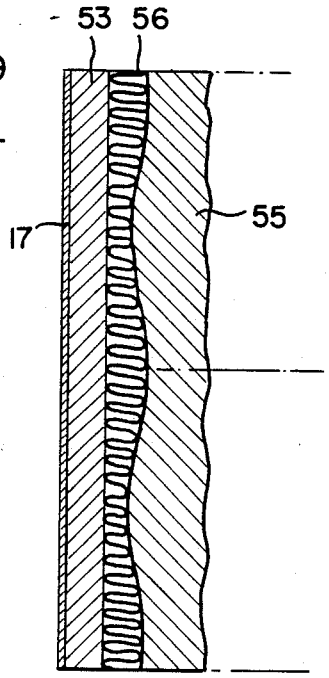
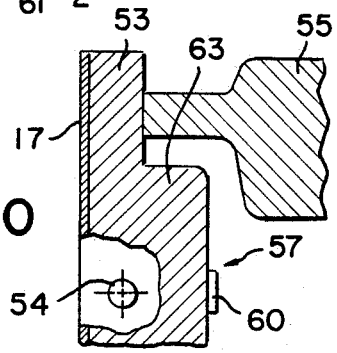
FIG. 60

FIG. 68
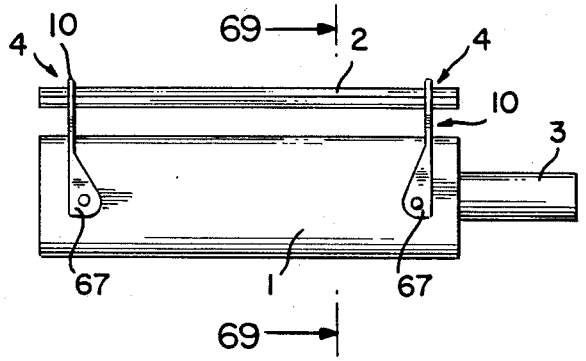
FIG. 69
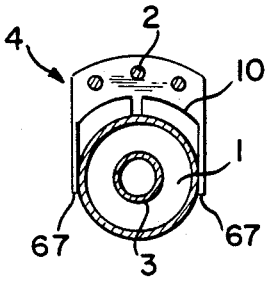
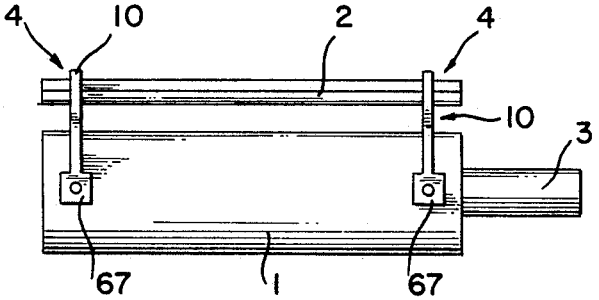
FIG. 70
FIG. 71
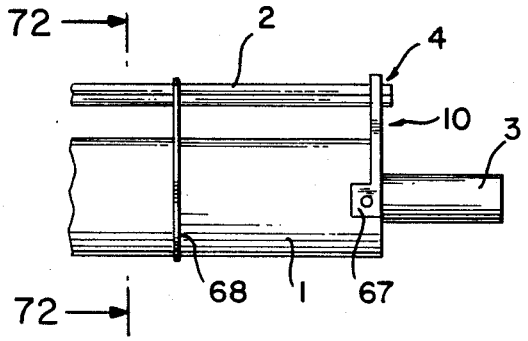
FIG. 72
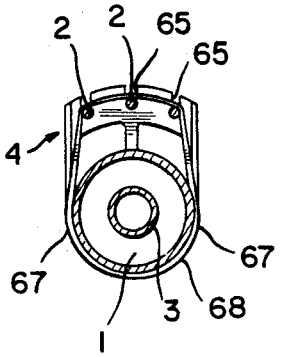

FIG. 79
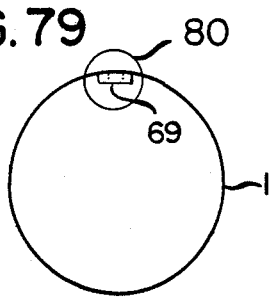
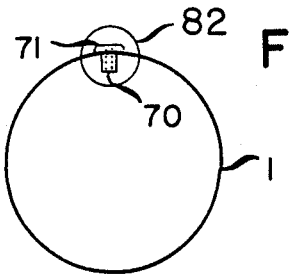
FIG. 81
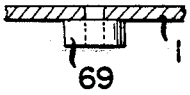
FIG. 80
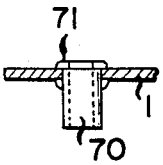
FIG. 82
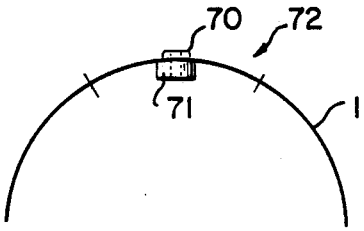
FIG. 83
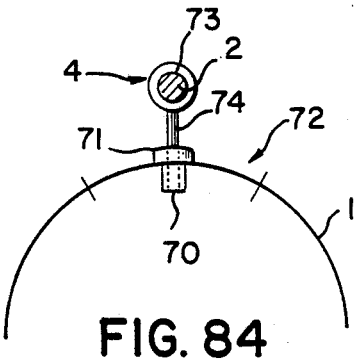
FIG. 84
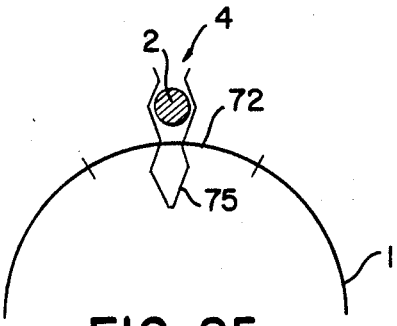
FIG. 85
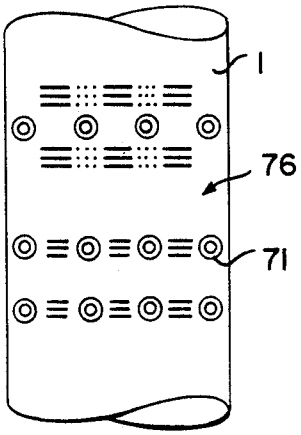
FIG. 86

FIG. 91
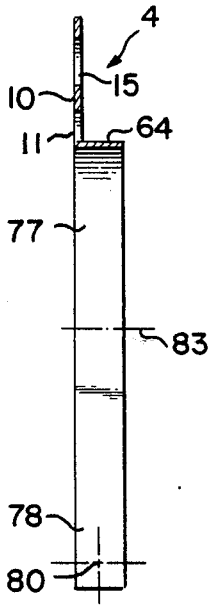
FIG. 92
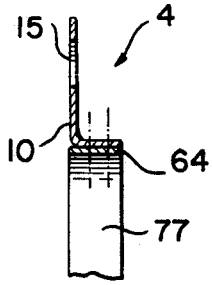
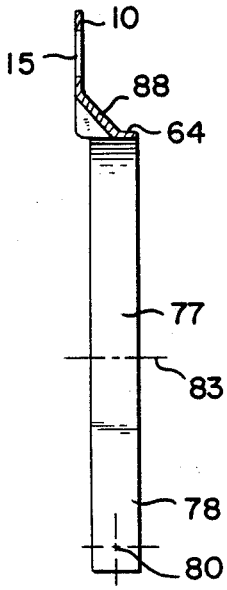
FIG. 93
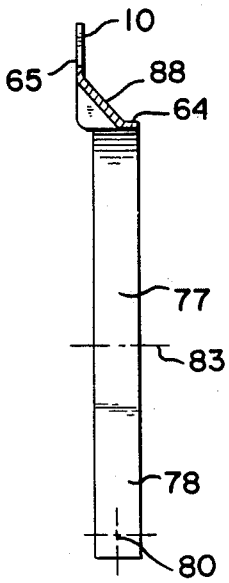
FIG. 94
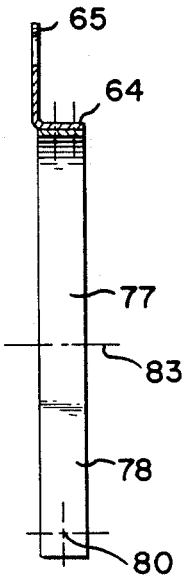
FIG. 95

FIG. 99
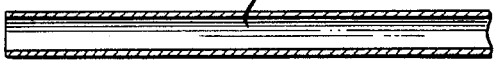
FIG. 101
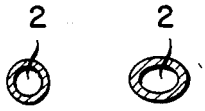
FIG. 100
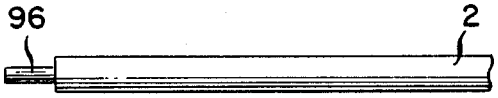
FIG. 102
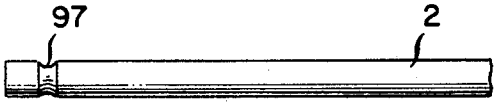
FIG. 103
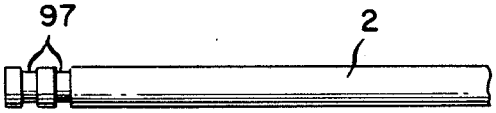
FIG. 104
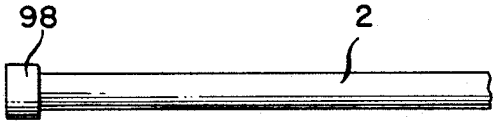
FIG. 105
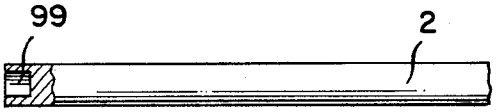
FIG. 106
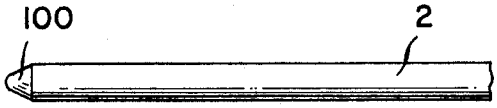
FIG. 107

FIG. 108
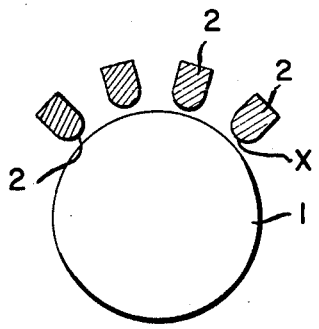
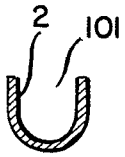
FIG. 109
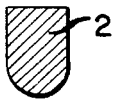
FIG. 110
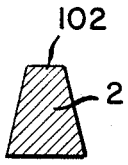
FIG. 111

FIG. 114
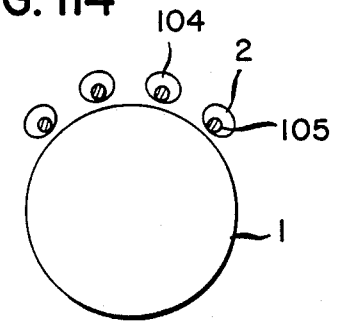
FIG. 115
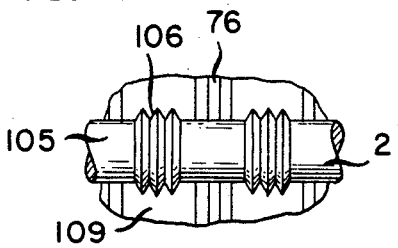
FIG. 116
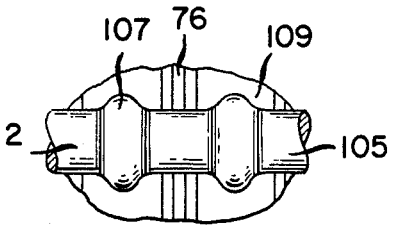
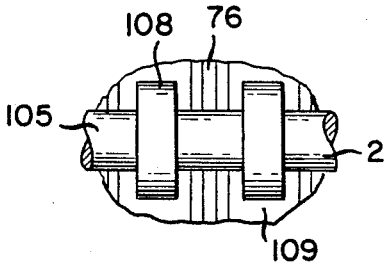
FIG. 117

FIG. 120
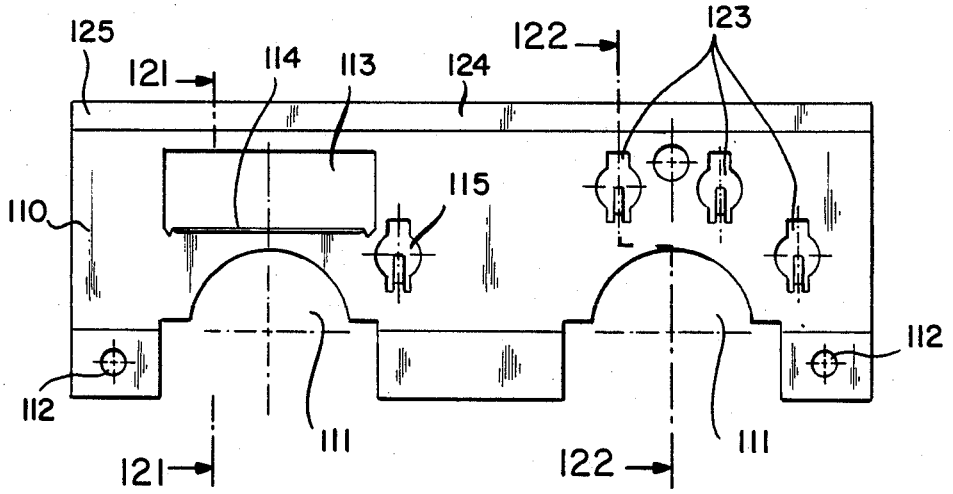
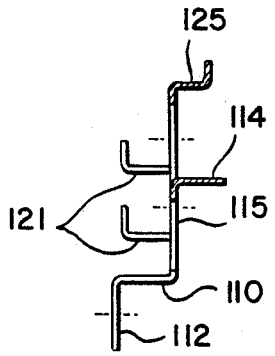
FIG. 121
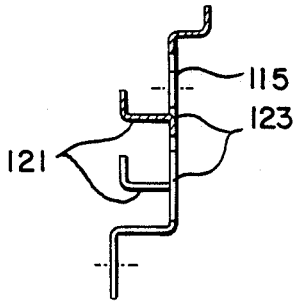
FIG. 122

BURNER, IN PARTICULAR ATMOSPHERIC PRE-MIX GAS BURNER, AND COOLING RODS THEREFOR

The invention pertains to a burner, in particular an atmospheric pre-mix gas burner, having at least one elongated burner pipe disposed beneath a burner chamber. The wall of the pipe is provided with fuel outlet openings at its upper side. The fuel outlet openings are oriented toward the inside of the burner chamber. The fuel outlet openings are arranged in groups for a fuel, in particular a fuel-air mixture, fed to the inside of the burner pipe.

In the case of such burners, so-called cooling rods, for instance ceramic or steel rods, water-filled rods, and the like, serve the purpose of taking away heat from the immediate vicinity of the burner flames for preventing reliably an overheating of the burner, which overheating could lead to a formation of nitrous oxides.

It is an object of the invention to develop and arrange such cooling rods in such a way that their intended purpose will be optimally fulfilled. The invention is directed in particular to fixing and mounting these cooling rods, in their optimally ideal position in relation to the burner pipe, by means of supports that are easy to manufacture and are of a compact construction. The cooling rods should be held in these supports, free of temperature-change induced tensions in such a way that, on the one hand, one can position these cooling rods without much help and skilled intervention into the ideal position during installation and, on the other hand, these cooling rods can be exchanged without much effort and loss of time if this becomes necessary.

In order to ensure the best possible position of such cooling rods, attention has not only to be paid to the position and arrangement of a group bundle of fuel output openings, disposed at the upper side of the pipe wall, but also to numerous other parameters such as the height of the flames formed at these output openings, the diameter and the distance of the cooling rods relative to each other and relative to the burner pipe, as well as the kind of connection between the holders and the burner pipe.

According to the invention, the above-defined object is obtained by disposing at least one cooling rod for the cooling of the core region of the flames formed at the fuel output openings inside the burner chamber, at a distance above the upper side of the pipe wall. The cooling rod extends at least over the remaining free region between the group bundle of the fuel output openings of the burner pipe. The cooling rod is made out of a heat-resistant and thermally-conductive material.

Based on construction, the cooling rods are able to remove heat from areas of the burner which are particularly endangered by and subject to overheating. Thus, the cooling rods effectively oppose the formation of nitrogen oxide.

If several cooling rods are disposed next to each other, it is preferable if these exhibit a distance of uniform size from the upper side of the burner pipe provided with the fuel output openings, that is, the optimum size can be determined empirically from case to case and is to be adhered to by the formation of the supports of the rods.

The teaching according to the invention can be carried out in a variety of ways.

Thus, the cooling rods can be disposed between the burner pipes that are running parallel and are adjacent to each other in the case of a so-called grid burner having a number of burner pipes placed next to each other and parallel to each other.

Furthermore, a disposition of the cooling rods could be chosen within the framework of the invention, such that the cooling rods follow at a distance from each other, in a course crosswise to the axis of the burner pipe, for example, representing a circular-shaped contour of the upper side of the, for example, cylindrical burner pipe, that is, for example, following the curve of a semi-circle.

However, within the scope of the invention, an embodiment of the burner is preferred where the cooling rods are located in longitudinal direction of the individual burner pipes and above the upper side of the burner pipe. Preferably, the cooling rods are placed at a uniform distance from the axis of the burner pipe. It might be sufficient to dispose only one support, either in the middle or at one of the two ends, over the length of the cooling rods. However, it is preferred within the scope of the invention to provide one support each at each of the two opposite end regions of the cooling rods or, respectively, of the burner pipes, where one of the supports can serve to fix the axial position, and where the other support can fix the radial position of the cooling rods.

It is more advantageous for the individual supports to be shared by several cooling rods running parallel to one another.

A multitude of possibilities exists for constructing of such suitable supports within the scope of the invention.

The invention provides a burner, in particular an atmospheric pre-mix gas burner, with at least one longitudinally extended burner pipe disposed below a burner chamber, where the pipe wall of the burner pipe is provided with group-wise disposed fuel exit openings for a fuel to be fed into the interior of the burner pipe, and in particular for a fuel-air mixture at the upper side disposed toward the interior of the burner chamber, characterized in that at least one cooling rod, consisting of a thermally stable and thermally conducting material, extends inside the burner chamber in a distance (x) above the upper side of the pipe wall at least over free regions remaining between the bundles of fuel exit openings of the burner pipe, where the cooling rod (2) serves to cool the core region of the flames formed at the fuel exit openings.

Several cooling rods (2) can be disposed at distances next to each other and exhibit a distance (x) of uniform size from the upper side (7) of the burner pipe (1), where the upper side (7) is provided with fuel exit openings (FIGS. 1–10).

The cooling rods (2) can be disposed in each case between burner pipes neighboring to each other and running in each case parallel relative to each other (FIG. 10).

The cooling rods (2) can be disposed at a uniform distance (x) above a plane (8) determined by the planar upper side (7) of the burner pipe (1) provided with the fuel exit openings and running parallel to the axes of the burner pipes (1) (FIG. 10).

The cooling rods can be disposed in their course cross-wise to the axis of the burner pipe (1) following, for example, the circular contour of the upper side (7) of the, for example, cylindrical burner pipe (1) at a distance (x) and the cooling rods are, for example, curved semi-circular and disposed at distances from each other (FIGS. 118, 119).

The cooling rods (2) can be disposed in the free regions (109) between the groups of fuel exit openings (76) placed at a distance from each other in longitudinal direction of the burner pipe (1) (FIG. 119).

The cooling rods (2) can be running in longitudinal direction of the individual burner pipe (1) above the upper side (7) of the individual burner pipe, where the cooling rods are disposed preferably at a uniform distance (x) from the axis of the burner pipe (1) (FIGS. 1–9, 11–98).

Only one support (4) can be provided over the length of the cooling rods (2) (FIGS. 1–4).

This support (4) can be provided approximately in the middle along the length of the cooling rods (2) or, respectively, of the burner pipe (1) (FIGS. 1, 2).

This support (4) can be provided in one of the two end regions of the cooling rods (2) or, respectively, of the burner pipe (1) (FIGS. 3, 4).

At least one support (4) in each case can be provided at each of the two end regions, disposed opposite to each other, of the cooling rods (2) or, respectively, of the burner pipe (1) (FIGS. 5, 6, 11–71, 87–98).

One of the two end-side supports (4) can serve for the axial and the other for the radial fixation of the cooling rod (2) (FIG. 61).

Joint supports (4) can be provided for several cooling rods (2) running parallel to each other (FIGS. 1, 2, 5, 6, 12–78, 87–97).

All cooling rods (2) supported in a joint support (4) can exhibit the same uniform distance (x) from the upper side of the wall of the burner pipe (1) (FIGS. 5, 6, 12–19, 22–27, 32–34, 37–39, 41–43, 47–49, 61, 71, 87–97).

A burner pipe can be provided where the fuel exit openings of the burner pipe are arranged in groups, which exhibit distances from each other in the longitudinal direction of the burner pipe, characterized in that the cooling rods (2) extend both over the regions provided with fuel exit openings (76) as well as over the regions (109) free of fuel exit openings (FIG. 98).

The cooling rods (2) can be formed thicker above the free regions (109) than in the regions above the fuel exit openings (76) (FIGS. 114–117).

The cooling rods (2) can exhibit above the free regions (109) thicker areas, for example, ribs (106), bulges (107), sleeves (108), or the like (FIGS. 115–117).

The profiled cooling rods are preferably of a cylindrical profile and where the diameter (d) is preferably uniform and where the diameter of the cooling rods is approximately equal to the preferably uniform distance (x) of the rods from the wall of the burner pipe (1) or is smaller by up to one fifth of this distance (x) (FIGS. 7–9).

The size of the center angles (alpha), which enclose defined radii (r) of the circular arc-shaped upper side (7) of the burner pipe (1), with each other can correspond to the size of the center angles determined by the free regions between the groups of fuel exit openings and where the center angle is preferably from 15 to 30 degrees (FIGS. 7 to 9).

The rod supports (4) can be disposed in one partial circular arc extending over the upper side of the burner pipe (1) for a maximum of five cooling rods (2) (FIG. 7).

The distance of three inner cooling rods (B, C, D) can be smaller from each other as compared to the distance of the two outer rods (A, E) from the rods (B, D) neighboring to them on the inside.

The rod supports (4) can be disposed in a partial circular arc extending over the upper side of the burner pipe (1) for at most four cooling rods (2) (FIG. 8).

The distance of the two inner rods (B, C) from each other can be larger than the distance of the two outer rods (A, D) from the inner rods (B, C) neighboring the two outer rods (A, D) (FIG. 8).

A burner pipe can be provided with at least two groups of fuel exit openings extending in the longitudinal direction of the burner pipe as well with groups extending in cross groups of exit openings of minimum size for maintaining flames, characterized in that the size of the center angles (alpha) enclosed by the radii (r) correspond to the arc length of these cross groups (FIGS. 7–9).

The distance (x) of the cooling rods (2) from the burner pipe (1) can vary in the course of the total length of the cooling rods (FIGS. 26–28, 37–40, 115–117).

The individual support (4) can exhibit individual support arms (10) for each of the cooling rods (2) starting at a joint base (5, respectively, 23) serving for the attachment to the burner pipe (1) or for the attachment of a inlet pipe (3), which inlet pipe runs coaxial to the burner pipe (1) and serves for feeding in of the fuel (FIGS. 12–17, 22, 23, 26, 27, 31).

At least one of the supports (4) can be formed as a disk (5) with a circumference adapted to the cross-section of the burner pipe (1), where the disk (5) can be attached on the front of the burner pipe (1) and possibly be inserted into the open front side of the burner pipe (1) with an extension and disk (5) closes this burner pipe (FIGS. 5, 6, 11–23, 26, 27, 29, 32–34, 37–39, 41–43).

A substantially horizontally disposed support ledge (21–24, 29, 46, 57) can be coordinated to the burner pipe (1) at at least one of its two front faces for supporting cooling rods (2) extending longitudinally over the region of the fuel exit openings (FIGS. 29–36, 44–60).

The burner pipe (1) can be closed with a front plate (5), which front plate (5) supports a web (34) projecting perpendicularly toward the outside, which web (34) penetrates with its free edge region (35) a slot (36) of a support ledge (29) attached to the web (34) (FIGS. 52–54).

The edge region (35) of the web (34) can be bordered by slots (38), and the support ledge (29) can be hooked into the slots (38) (FIGS. 52–54).

At least one end (37) of the edge region (35) formed by a limiting slot (38) can be deformed for the attachment of the support ledge (29) at the web (34) and is for example canted (FIGS. 52–54).

The web (34) can be angled in an edge region disposed opposite to the support ledge (29) and that the web (34) is contactingly attached with the angle arm (39) at the front plate (5) of the burner pipe (1), for example by welding (FIGS. 52–54).

The support ledge (29) can be provided with openings (49) for the access of secondary air to the burner pipe (1) disposed in the burner chamber (FIGS. 52–54).

The support ledge (29) can form supports (13) at its upper edge for cooling rods (2) by way of punched tongues (FIGS. 52–54).

The free end (41) of the tongue (42) forming the support (13) can be upwardly angled for fixing the axial dispositin of the individual cooling rods (2) (FIGS. 52–54).

A bow (44 or, respectively, 68) or the like tensioning member can be provided for securing the cooling rods (2) against a falling out of the supports (4), which bow or the like extends crosswise over these cooling rods and can be anchored (FIGS. 52–54, 71, 72).

The bow (44) can be anchored with its two angled ends (43) in the recesses of the support ledge (29).

The support ledge (21–24, 29, 46, 57) can be attached at a burner plate (17) carrying at least one burner pipe (1) and limiting the burner chamber (FIGS. 22, 23, 29, 30, 35, 36, 44–60).

A flange (45) of the support ledge (46) resting at the burner plate (17) can be provided with a perpendicularly protruding web (47), which web (47) penetrates a slot (48) of the burner plate (17) (FIGS. 55–57).

The edge region (49) of the web (47) protruding from the slot (48) can be deformed, that is, for example, angled for supporting the support ledge (46) (FIGS. 55–57).

A flange (50) of the support ledge (46) can support in at least one recess at least one cooling rod (2), where the flange (50) is directed downwardly, is staggered, and is running parallel to the burner plate (17) (FIG. 56).

The support ledge (46) can carry at least one flap (51), where the front face of the cooling rod (2) rests at the flap (51) for the purpose of fixing an axial position (FIG. 56).

Supports (4) can be formed as a single-piece unit (9) jointly with the cooling rods connecting the supports 4 and where the unit (9) possibly includes pilot elements (20) and where the supports (4) are joinable at the two ends of the burner pipe (1) (FIGS. 15–17, 41–43, 66, 67).

A support (4) can for example be formed like a disk and is provided with recesses, closed around the circumference, such as, for example, holes (15), or grooves (65) or niches (13) open in upward direction, for providing passage and for the locking support of the cooling rods (2) (FIGS. 1–6, 11–14, 20–52, 56, 58, 61–64, 68–72).

For example, a disk-shaped support (4) can be provided with at least a recess dimensioned according to the cross-section of a cooling rod (2), such as, for example, a sack hole (14) for providing a locking connection with such a cooling rod (2) (FIG. 21).

Several cooling rods (2) of the same length can represent a single-piece unit (9), which can be inserted between two supports (4) joined on two sides to the front face of the burner pipe (1) (FIGS. 12–14).

Preferably, a disk-shaped support (4) can form a recess (11) for the passage of a pilot element (20) directed against the fuel exit openings of the burner pipe (1) (FIGS. 26, 27, 32–34, 37–39).

The ends of the cooling rods (2) directed to pilot element (20) can be upwardly offset at one of the front faces of the burner pipe (1) for placing pilot element (20) into a hollow space (16) formed below the cooling rods (2) (FIGS. 26–28, 37–40).

The support of the pilot element (20) can form one of the two supports (4) of the cooling rods (2) and where the support is, for example, a burner plate (17) (FIGS. 28, 36, 40, 47–50).

A wall (17 or, respectively, 27, 33) limiting the burner chamber can serve as a support (4) of the cooling rods (2) with a flange (11) adjoined to the wall or punched out of the wall with an angle profile (23 or, respectively, 29), with a cage (26), or the like (FIGS. 29, 30, 36, 40, 44–50).

A burner plate can form a front closure of the burner chamber, characterized in that the burner plate (17) carrying at its inside an insulation (53) also carries at its inside both an attachment for the insulation (53) as well as for the support (4) as well as a profile (57), which serves at least for the support (4) of a cooling rod (2) running parallel to the burner pipe (1) (FIGS. 58–60).

The profile (57) can be provided with a flange (58) resting at the inside of the burner plate (17) and attached to the burner plate (17), a web (59) projecting from the burner plate (17) by an amount corresponding to the thickness of the insulation (53), as well as an edge flange (60) directed upwardly and gripping around the lower edge of the insulation (53) and at least one downwardly directed flange (61) serving for supporting at least one cooling rod (2) (FIGS. 58–60).

At least one downwardly directed tongue (62) coordinated to the front face of the cooling rod (2) can be provided at the profile (57) for the axial fixation of the profile (57) (FIG. 58).

A distance formed between the insulation (53) and the boiler composed out of members (55) can have a varying width and is filled with a soft ceramic or mineral insulating material (56) (FIGS. 58 and 60).

The burner plate (17) can be provided at its upper edge with an edge flange (52) directed inwardly against the burner chamber, where the edge flange (52) is penetrated by a pin (54) fixing the insulation (53) (FIGS. 58, 60).

The insulation (53) can be provided at its edge with a step-like shoulder (63), where parts of the burner chamber wall lockingly engage the step-like shoulder (63) and where possibly the boiler members (55), limiting the burner chamber, lockingly engage the step-like shoulder (63) (FIGS. 58–60).

A support (4) can be profiled with a flange (21, 22, 24) directed downwardly against the fuel exit openings of the burner pipe (1) or the like member for the support of the cooling rods (2), where the support (4) is disposed at the front face of the burner pipe (1), for example at the burner pipe (1) itself, at the fuel feed line (3), and/or at a wall (17) of the burner chamber. (FIGS. 29, 30, 32–36).

This support (4) can delimit a space (16) with the flange (24) of the support (4) and where at least one pilot element (20), and preferably a pair of such pilot elements (20), which are attached at the support (4) and/or at the burner chamber wall (17), protrude into the space (16) (FIGS. 32–36).

The supports (4) of the two mutually oppositely disposed ends of the cooling rods (2) and the end (18) of the burner pipe (1) disposed opposite to the fuel feed line (3), can be connected with each other via a support arm (19) protruding from the burner plate (17) and running parallel to the burner pipe (1) (FIGS. 24, 25).

At least one of the supports (4) can comprise a metallic or ceramic form piece (64), which form piece is profiled at an angle and attached at a wall of the burner pipe (1), which wall is at least over a certain region cylindrical, and/or attached at the fuel feed line (3), where the metallic or ceramic form piece (64) has one arm resting at the wall and where the upright arm of the form piece (64) forms a support (FIGS. 61–67).

For example, the disk-shaped support (4) can be attached with two webs (67) at the burner pipe (1) where the web (67) are tangenting the wall of the burner pipe (1) and flanking relative to wall of the burner pipe (1) (FIGS. 68–72).

The cooling rods (2) can be supported at the inner wall (17) of the burner chamber in guide cams (28) or such insertable ledge-shaped supports (4) independent of the coordinated burner pipe (1) and the fuel feed line (3) of the burner pipe (1) (FIGS. 44 to 51).

The ledge-shaped horizontal supports can be provided as support ledges (29) with recesses (15, 65), where the recesses serve for receiving cooling rods (2) with different height levels at equal distances from the wall of the burner pipe (1) (FIGS. 47–49).

The support (4) can comprise structures (12) formed of band or wire and forming a loop, which at least regionally surrounds at least one cooling rod (2) (FIGS. 18, 19, 73–78).

The band or wire structures (12) can surround the cooling rods (2), closingly around the circumference of the cooling rods, and form double-wall support webs below these cooling rods (2) (FIGS. 73, 74).

The band or wire structures can form divergingly spread support legs below the cooling rods (2) (FIGS. 75, 76).

The band or wire structures (12) can rest in a pairwise arrangement in each case only at the flank regions of the cooling rods (2) and that the band or wire structures (12) form divergingly open supports (4) above these flank regions.

A tensioning element (68) can be tensioned around the burner pipe (1) and the cooling rods (2) supported by the tensioning element (68), where the tensioning element (68) is made of a preferably elastic material and serves for securing during transport (FIGS. 71, 72).

The wall of the burner pipe (1) can be provided with prefabricated anchoring members (69–71) for demountable and independently settable attachment of the support of the cooling rods (2) in the region of the fuel exit openings (76) (FIGS. 79–86).

The anchoring members can comprise bores and, preferably, threaded bores (69).

Threaded nuts (70) can be attached at the outside and inside of the wall of the burner pipe (1) coaxial with bores.

Elements such as threaded bushings or the like (71) can penetrate the pipe wall of the burner pipe (1) and are provided with an inner thread (FIGS. 81, 82, 84).

Supports (4) can be provided which can be screwed by way of a threaded bolt (74) into anchoring members (69–71) provided with an inner thread (FIG. 84).

Supports (4) can be attached with a pin (75) or the like, can be insertable into bores (69) of the wall of the burner pipe (1), and are preferably spring-locked and/or are frictionally attached in such bores (69) (FIG. 85).

The cooling rods (2) can be attached indirectly via support elements (73–75) which are anchored in anchoring members (69–71) at the wall of the burner pipe (1) (FIGS. 84, 85).

The supports (4) can be attached at pipe clamps (77), where the clear diameter of the pipe clamps corresponds to the outer diameter of the burner pipe (1) and where the pipe clamps can be clamped to this conforming burner pipe (FIGS. 87–97).

In each case at least two pipe clamps (77) can be used, one of which is provided with a support (4) for radially fixing of the cooling rods and where the other pipe clamp is provided with a support (4) for inserting and bottom-support providing for the cooling rods (2) (FIGS. 87 or, respectively, 90).

One of the two supports can be provided with holes 15, closed around the circumference, for providing radial fixation. The second support can be provided with narrowing grooves 65 for axial fixation of the cooling rods in the grooves 2 (FIGS. 87, 90, or, respectively, 96, 97).

A bow (89) can be provided, which bow can be attached at the support (4) formed with grooves (65) for clamping the cooling rods (2) disposed in the grooves (FIG. 96).

Anchoring members (84, 86 or, respectively, 85, 87) for the bow (89) can be provided at the two flanks of the support (4).

A cooling rod can be provided for a burner, which cooling rod can be provided with a full profile (FIGS. 110–112).

The cooling rod can be provided with a hollow profile (FIGS. 99 to 101, 109).

The cooling rod can carry at least at one of its ends a pin (96) for attachment in its supports (4) (FIG. 102).

The cooling rod can be provided at least at one of its ends with at least one annularly surrounding groove (97), a collar, a bushing, or the like, providing a cross-sectional change, for attachment in its supports (4) (FIG. 103).

Two or more such grooves (97) or the like can be disposed at a distance from each other (FIG. 104).

The cooling rod can carry a head (98) at at least one of its ends for attachment in its supports (4) (FIG. 105).

The cooling rod can be provided with at least one axial recess (99) at at least one of its ends for attachment in its supports (4) (FIG. 106).

The cooling rod can form a cone (100) at at least one of its ends for attachment in its supports (4) (FIG. 107).

The cooling rod can exhibit a circular cross-sectional contour (FIG. 100).

The cooling rod can exhibit an oval cross-sectional contour (FIG. 101).

The cooling rod can exhibit a polygonal cross-sectional contour (FIGS. 111, 112).

The cooling rod can narrow in its cross-section toward the front face directed toward the burner pipe (1) (FIG. 111).

The cross-section of the cooling rod can be rounded at the front face directed toward the burner pipe (1) and is preferably semi-circular (FIGS. 108, 109).

The surface of the cooling rod can be arranged in a plurality of holes, warts, or such unevennesses (FIG. 113).

The support can comprise a sheet-metal piece (110) which exhibits recesses (115, 123) coordinated to the cooling rods, which recesses serve for supporting the rod and where a flap (121) is coordinated to the recesses, whereby the longitudinal play of the cooling rod is limited.

The burner pipe, which is coordinated to a pilot burner, need not support all cooling rods in the joint support (110), but one or more cooling rods are supported by a separate support immediately coordinated to the burner pipe.

In fact, the supports can be mounted at the burner pipe itself and/or at the fuel input pipe and/or at a casing side adjoining the burner chamber, that is, at the so-called front burner plate that supports the burner pipes.

In order to gain a better understanding of the various possibilities that result from this invention, various examples of embodiments are exemplified hereafter by means of the drawings, in which:

FIGS. 1 to 6 show basic possibilities for the attachment of the cooling rods to the burner pipe;

FIGS. 11 to 98 show variants of the attachment of the cooling rods, that are coordinated parallel to the axis of a single burner pipe;

FIGS. 99 to 118 show the configuration of individual cooling rods;

FIGS. 117 to 118 show an embodiment employing cooling rods running crosswise to the burner pipe, and FIGS. 119 to 124 show further variants of the burner-rod support.

Figure 7:
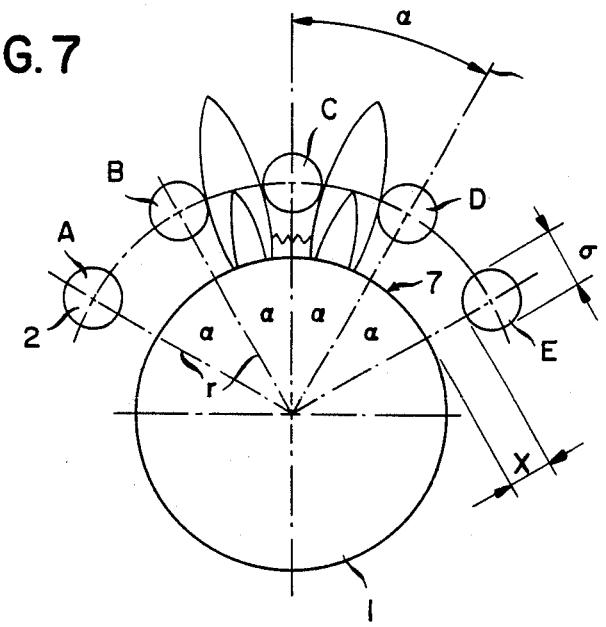
FIGS. 7 to 9 show, in cross-section, advantageous layouts of the cooling rods in relation to the burner pipe.

FIGS. 1 and 2 show atmospheric gas burners in a longitudinal view, also partially in section, as well as in cross-section. The atmospheric gas burners have an elongated burner pipe 1 disposed below a burner chamber, not shown. The siding of the burner chamber is provided at the upper side 7 of the burner chamber with fuel output openings, not shown. The fuel outlet openings are, for example, hole and slot-shaped, bundle and group-wise arranged. The fuel inlet openings are for a gas-air mixture fed to the burner pipe 1 via a fuel feed line 3.

For example, three cooling rods 2, made out of ceramic material or steel, are provided above these fuel outlet openings. The cooling rods run parallel to the axis of the burner pipe 1 and in a clear nominal distance x of the upper side 7 of the wall of the burner pipe 1. The cooling rods serve for the deflection of the heat from the flame area of the gas burner.

Only a joint support 4 is provided for all rods 2 which, in the embodiments of the gas burner shown in FIGS. 1 and 2, is situated at the longitudinal center of said rods. The support 4 extends over the entire length of the parallel running cooling rods 2, and the support is attached at the burner pipe 1 jointly for all rods 2.

Supports 4 are provided, in the same manner as in the embodiment illustrated in FIGS. 3 and 4, also only at one location of the longitudinal course of the cooling rods. The supports, however, are disposed in one of the two end regions of the burner pipe 1, and a separate support 4 is coordinated to each cooling rod 2. All cooling rods 2 have the same uniform distance x from the wall of the burner pipe.

According to the invention, the arrangement in each case of one support 4 at the two front faces of the burner pipe 1 is preferred, as can be recognized from FIGS. 5 and 6. The supports 4 are, for example, formed at the front plates 5. The front plates close off the front sides of the burner pipe 1.

These supports 4 are joint to all cooling rods 2 running parallel to each other. These cooling rods 2 are all provided with the same uniform radial distance x from the cylindrical wall of the burner pipe 1, as do the cooling rods according to FIGS. 3 and 4.

Figure 8:
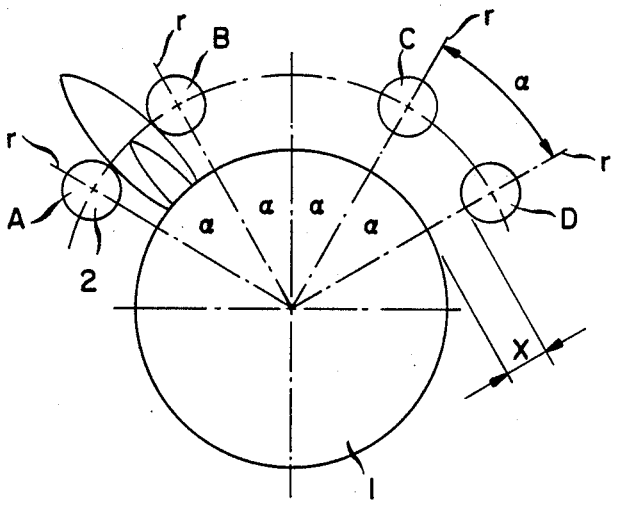
Figure 9:
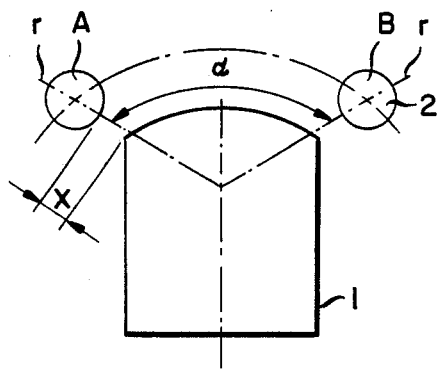

Schematic possibilities for a sensible distribution of the cooling rods 2 above the upper side 7 of the burner pipe 1 are illustrated in FIGS. 7 to 9. The upper side 7 of the burner pipe 1 is provided with exit openings for the fuel.

A cylindrical burner pipe 1 with five cooling rods 2 is shown in detail, in cross-section, in FIG. 1. The five cooling rods 2 are attached at five supports and the five cooling rods 2 extend above the group bundles of fuel exit openings which pass through the pipe wall and which are disposed running in longitudinal direction and parallel with respect to each other. The five cooling rods 2 extend in fact above the free regions, which are free from openings, formed between these group bundles of burner exit openings.

The cooling rods 2, designated with the letters A to E, running from left to right, sequentially, have a diameter d of uniform size and clear distances x of uniform size from the wall of the burner pipe 1. The center angles, enclosed by radii r, defined by individual cooling rods 2, are designated with the Greek letter alpha.

The distances x correspond approximately to the distance of the core zones of the flames formed during full operation at the exit openings from the burner pipe wall. The distances x amount, in practial situations, to from about 5 to 20 mm. The rod diameter d can be about equal to the distance x of the cooling rods from the burner pipe 1 or can be smaller than the distance up to a fifth of this distance x. The rod diameter thus amounts to from about 4 to 10 mm.

The size of the center angle alpha corresponds to the size of the free region between the longitudinally running group bundles of fuel exit openings of the burner pipe and amounts preferably to from about 15 to 30 degrees.

According to the embodiment of FIG. 7, the burner pipe 1 can be provided with any supports, which are not shown and which are preferably disposed at the front side, for at most five cooling rods 2, designated as A to E. If desired, only four cooling rods 2 can be inserted in the same supports, for example only the cooling rods A,B,C,D, the cooling rods B,C,D,E, or the cooling rods A,B,D,E.

If one finds that, corresponding to the burner power required, only three cooling rods 2 are sufficient, then these could be the cooling rods A,C,E, or B,C,D.

Finally, it is conceivable that only two cooling rods 2 are positioned, where this could be the cooling rods B and C, the cooling rods B and D, or the cooling rods C and D.

Thus, the number and arrangement of cooling rods 2 can be adapted within the scope of the invention substantially to the requirements in each case, i.e. adapted, in each case, to the burner power and burner construction, to the local heating value of the gas or the like parameters, in a sensitive way without there being time and expense requirements for preparatory work or adaptions.

The embodiment illustrated in cross-section in FIG. 8 allows that at most four cooling rods 2, designated with letters A to D, can be coordinated to the burner pipe 1 and the cooling rods 2 can be inserted in supports provided for this purpose. In case only three cooling rods are placed in these supports, then these could be the rods A,B,C, or the rods B,C,D, and in case of an arrangement of only two cooling rods, these could be the rods A,D or B,C.

FIG. 9 also illustrates in cross-section a burner pipe 1 with only two group of bundles of exit openings extending in the longitudinal direction of the burner pipe 1. The two cooling rods 2, with designations A and B, are coordinated to the exit openings on the side. Exit openings of minimum size for so-called pilot-maintaining flames can be provided and arranged in cross bundles between the bundles of burner exit openings extending in longitudinal direction. The size of the center angle alpha corresponds then to the length of these cross bundles of pilot-maintaining flames.

According to this embodiment, the burner pipe 1 is formed with, for example, a substantially rectangular cross-section and only the upper side 7 of the burner is accurately curved along a circle section and is provided with fuel exit openings.

In addition, the distances of the cooling rods 2 from each other can be dimensioned differently in case that more than four cooling rods are placed, as is shown in FIGS. 7 and 8. For example, according to FIG. 7, the distance of three inner rods B, C, and D from each other can be smaller than the distance of the two outer rods A and E from the inner rods B and D which are neighboring to these outer rods A and E. In contrast, the distance of the two inner rods B and C from each other is larger than the distance of the two outer rods A and D from the inner rods B and C neighboring to these outer rods A and D according to FIG. 8.

Figure 10:
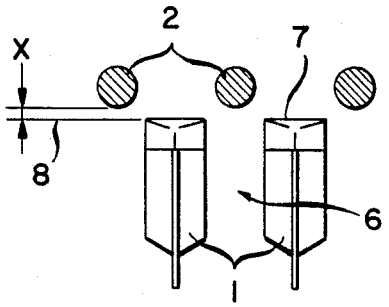
FIG. 10 shows the disposition of the cooling rods in the case of a burner grid.

It is also possible to employ burner pipes 1 with a planar top side 7 according to FIG. 10 and within the scope of the invention. In case of an arrangement of several such burner pipes running parallel to each other and forming a burner grid, the cooling rods 2 are then provided above the joint plate 8 of these upper sides 7 at distances 6. Thus, in each case, the individual burner pipe 1 runs between two neighboring cooling rods 2. All cooling rods 2 are placed at the same height level and run parallel to each other and parallel to the burner pipes 1 at a uniform distance x from the upper sides 7 of the burner pipes 1.

According to the embodiments illustrated in FIGS. 11 to 21 in longitudinal views or, respectively, in longitudinal and cross-sections, the supports 4 of the cooling rods 2 are formed as upwardly projecting continuations of disks 5. The disks 5 are joined to the front sides at the two ends of the burner pipe 1 and are formed with a contour which is adapted to the cross-section of the burner pipe 1. The individual support 4 is furnished with individual support arms 10 starting at the joint disk 5 serving for the attachment of the burner pipe 1. The individual support arms 10 are coordinated to each of the cooling rods 2. A variant is illustrated in a partial section according to FIG. 11. According to the variant, the disk 5 is provided with a correspondingly accurately fitting extension, which extension can be inserted into the open front side of the burner pipe 1. This disk 5 thus sealingly closes the front side. In addition, FIG. 11 illustrates that the front disk 5 can also be used for supporting the fuel feed line 3 at the opposite end of the burner pipe 1.

Figure 12:
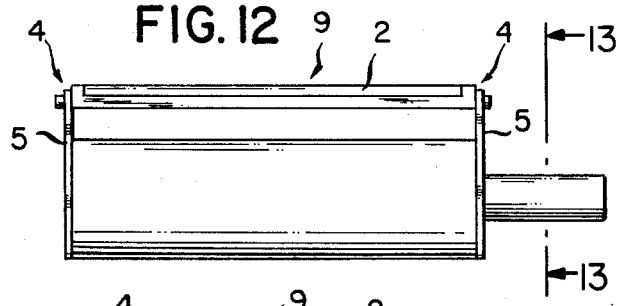
Figure 13:
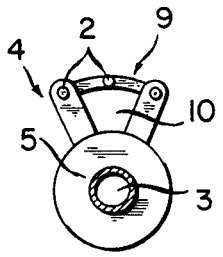
Figure 14:
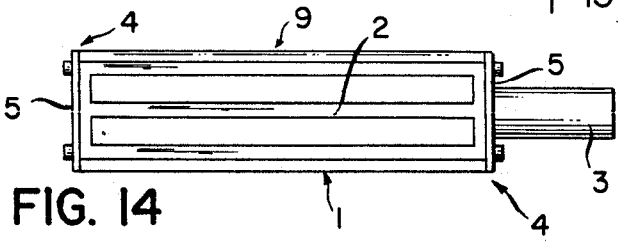

According to the embodiments illustrated in FIGS. 12 to 14, the three cooling rods 2, each of the same length, provide jointly a single-piece unit 9, which can be inserted between the two disks 5 attached to the front face of the burner pipe 1. The unit 9 is supported by only two support arms 10 of the supports 4.

Figure 15:
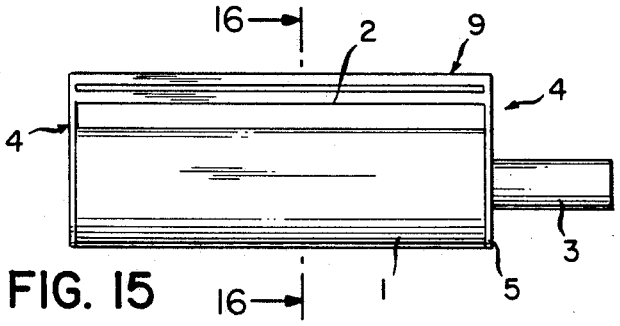
Figure 16:
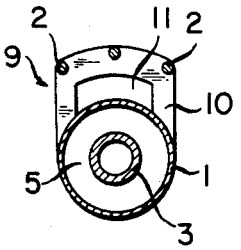
Figure 17:
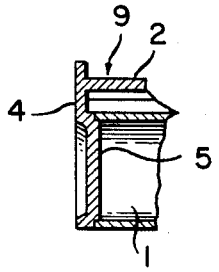

FIGS. 15 to 17 illustrate in longitudinal section, in cross-section, and in a partial longitudinal section, an embodiment according to which a unit 9, which can be attached at the two front ends of the burner pipe 1 with front disks 5, is formed as a single piece with the three cooling rods 2. At least one of the two front disks 5 of this unit 9 forms a recess 11 for a pilot element, which is not shown and which is directed against the fuel exit openings of the burner pipe 1.

An embodiment is shown in FIGS. 18 and 19 in a longitudinal section and in a cross-section, where the supports 4 comprise structures 12, formed from tape or wire, which surround the cooling rods 2 with loops. The structures 12 are connected to the burner pipe 1 in the region of the front faces of the burner pipe by way of disks 5.

Figure 20:
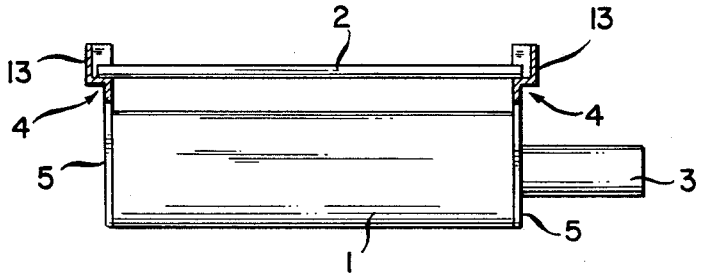

A further possibility of a structure of the support 4 is illustrated in a longitudinal view in FIG. 20. According to this embodiment, each of the two supports comprises a front face 5, which front face 5 is provided with niches 13 dimensioned corresponding to the cross-section of the cooling rods 2 or the like shape-adapted seats for supporting the ends of the cooling rods 2.

Figure 21:
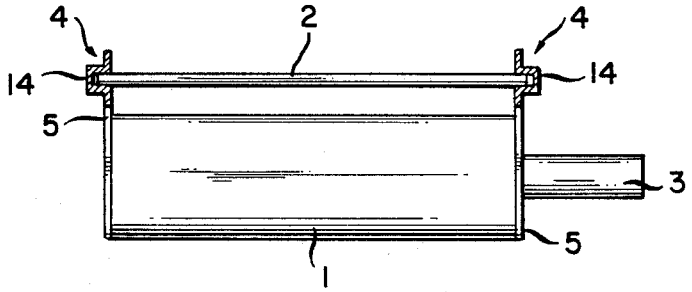

A variant is shown in like representation in FIG. 21. According to this variant, the supports 4 are formed as sack-holes 14 in the front disks 5.

A longitudinal view and a cross-sectional view of an embodiment are shown in FIGS. 22 and 23. According to this embodiment, one support 4 is represented by a front disk 5 joined to the burner pipe, which front disk 5 is provided with holes 15 for inserting of the cooling rods 2. The other support 4 is represented by support arms 10 of one front disk 5. Such support arms 10 can also be attached at one burner chamber wall, for example at a burner plate 17 enclosing the burner chamber on the front and supporting the burner pipe 1.

According to FIGS. 24 and 25, the supports 4 of the two ends disposed opposite to each other of the cooling rods 2 and the hole-peg supports 18 of the burner pipe 1 are connected to each other with a support arm 19 protruding from the burner plate 17 and running parallel to the burner pipe 1. Thus, the burner plate 17 carries indirectly the two ends of the cooling rods.

According to the embodiment illustrated in FIGS. 26 to 28, the ends of the cooling rods 2, directed toward a pilot element 20, are formed with an offset at one of the front faces of the burner pipe 1 for placing the pilot element 20 into a hollow space 16 disposed below the cooling rods 2. These offset ends of the cooling rods 2 can be supported in grooves 65 of the support 4 represented by the front face 5, as illustrated in FIG. 27. Alternatively, as shown in FIG. 28, the offset ends of the cooling rods 2 can be supported in holes 15 of a front side wall 17, for example of the burner plate or of the casing enclosing the burner chamber. This burner plate 17 is also interspersed by the fuel feed line 3 and supports this fuel feed line 3 and the pilot element 20 protruding into the space 16.

The embodiment according to FIGS. 29 and 30 provides that a burner plate 17, limiting the front side of the burner chamber of the burner pipe 1, serves as one of the two supports 4 of the cooling rods 2 with a perforated flange 21 (FIG. 29) attached to the burner plate 17 with a base 23, or with a flange 22 (FIG. 30) punched out of the burner plate 17 including the base 23. As is shown as a possibility in FIG. 31, the base 23 can also be supported at the fuel feed pipe 3 and can be used as a support 4.

A support 4 is disposed at the front side of the burner pipe 1 and formed at one front disk 5 according to FIGS. 32 to 34, similar as shown in the embodiments according to FIGS. 29 and 30. The support 4 is profiled with a perforated flange 24 serving as a support ledge and directed opposite to the fuel exit openings of the burner pipe 1 for supporting the cooling rods 2. The recess 11, limited by the support arms 10 of this flange 24, is interspersed by the pilot element 20.

FIGS. 35 and 36 illustrate that the recited flange 24, if desired, can also be attached at a base 23 surrounding the fuel feed line 3, or with such a base 23 at the burner plate 17.

The support 4 defines with this flange 24 a space 16 into which a pair of pilot elements 20 protrudes, which pilot elements are attached to the burner plate 17.

In turn, the cooling rods 2 of the embodiment according to FIGS. 37 and 39 are offset, as in the embodiment according to FIGS. 26 and 27, in order to provide space for the pilot element 20. The pilot element 20 is directed against the fuel exit openings of the burner pipe 1 through a recess 11 of the front face 5 supporting the support 4.

The single-piece unit 9 formed by three cooling rods 2 is attached via hole-peg connections 25 between the two supports 4 represented by holes 15 of the two front faces 5. FIG. 40 illustrates that, if desired, also one of the hole-peg connections 25 can be considered in a cage 26 attached to the burner plate 17.

Similar to the embodiments of FIGS. 15 to 17, there is shown, in the embodiment according to FIGS. 41 to 43, a single-piece unit 9, which can be placed onto a burner pipe 1 and which comprises the front disk 5 and the cooling rods. In addition, the single-piece unit 9 comprises also a pair of pilot elements 20 in its front region.

The cooling rods 2 are disposed completely independent of the coordinated burner pipe 1 according to the embodiment illustrated in FIGS. 44 to 51. The fuel feed line 3 of the burner pipe 1 is supported in support ledges 29, which support ledges are preferably of strip-shape and which support ledges 29 are attached at the inner walls 27 of the burner chamber running parallel to the cooling rods 2. The support ledges 29 comprise guide cams 28 or the like members of the inner walls 27 such as, for example, elements which can be form-lockingly inserted into boiler sections. These support ledges 29 form recesses 30 for supporting the cooling rods 2 which can be inserted into these recesses 30. These recesses 30 exhibit various height levels in the horizontal support ledges 29 (FIGS. 47 and 49), in order that the cooling rods 2, coordinated to a burner pipe 1, exhibit throughout equal distances from the pipe wall.

In order to fix the axial position of the cooling rods 2 supported in the recesses 30, there can be provided punched out or bent flaps 31 which protrude into the cross-section of the recesses. Members 32 serve to provide centering.

Figure 51:
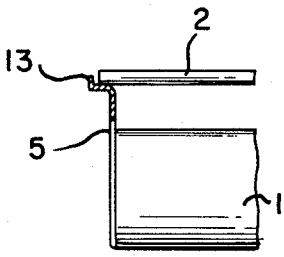

The wall of the burner chamber, disposed opposite to the burner plate 17, serves for providing a hole-peg support 18 of the burner pipe 1. The support ledges 29 are provided in part with groove-shaped recesses 30, and in part with holes 15. The support ledges 29 can also form support flanges 13, as is illustrated in FIG. 51.

Figure 52:
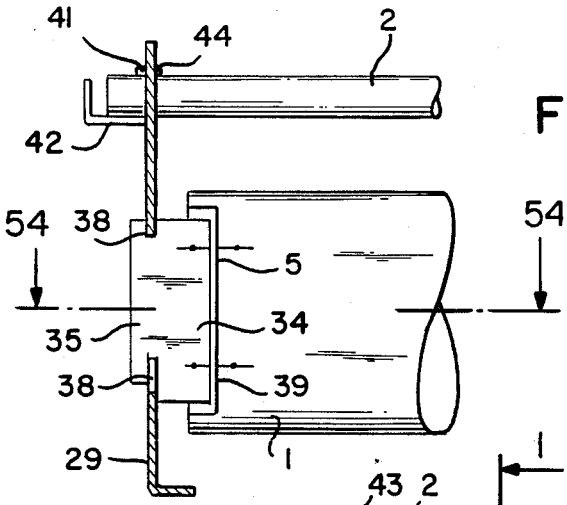
Figure 53:
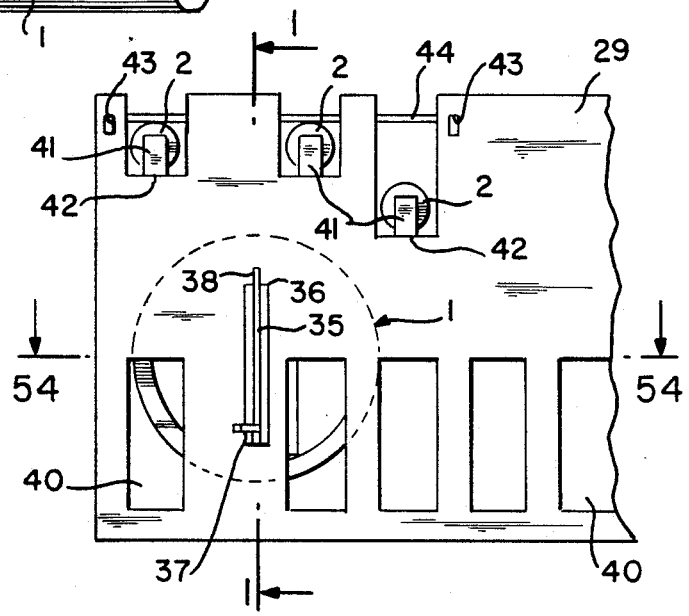
Figure 54:
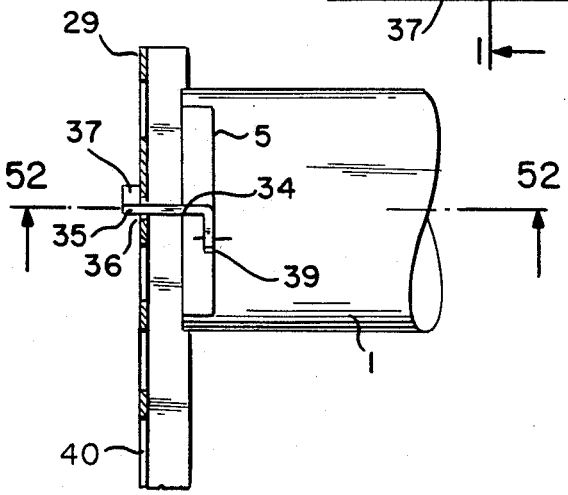

In addition, support ledges 29 can be employed within the scope of the present invention, which support ledges are attached indirectly to the burner pipe, as is illustrated in FIGS. 52 to 54. FIG. 52 is a vertical section, FIG. 53 is a front view, and FIG. 54 shows a horizontal section.

The burner pipe 1 is closed at its front face with a front plate 5. The front plate carries a web 34 disposed perpendicular and outwardly projecting. The web 34 penetrates with its free edge region 35 through a vertical slot 36 of the support ledge 29. A lower end 37 of this edge region 35, bordered by edge-parallel slots 38, is deformed for fixedly positioning the support ledge 29 at the burner pipe 1, under formation of an angle. The support ledge 29 can be hooked at the web 34 into the recited slots 38 and thus the support ledge 29 is connected to the burner pipe 1.

The web 34 is angled at its vertical edge disposed opposite to the support ledge 29. The web 34 is attached at the angle arm 39 resting at the front plate 5 of the burner pipe 1. The attachment can be for example by spot-welding.

The support ledge is furthermore provided with openings 40 for the access of secondary air into the burner chamber.

The support ledge 29, with punched out tongues 41, forms at its upper edge horizontal support rests 42 for the individual cooling rods 2, and these tongues 41 are angled upwardly for the fixation of the cooling rods in axial direction. A hookable rod of the kind of a bow 44 extends crosswise over the resting ends of the cooling rods 2 and can be hooked on two sides with angled ends 43 into recesses of the support ledge 29 provided for this purpose. The rod for a hook connection serves for securing the cooling rods 2 in the burner chamber, disposed with a uniform distance from the wall of the burner pipe 1, against a falling out.

The cooling rods 2 are demountably attached at the burner plate 17 limiting the burner chamber and without the aid of a special connecting members, at their end, disposed opposite to the support ledge 29. This is shown in FIGS. 55 to 57 again in a frontal view, in a vertical section, and in a horizontal section.

A flange 45 of the support ledge 46, resting at the burner plate 17, carries a vertically protruding web 47. The web 47 passes through a slot 48 of the burner plate 17. The edge region 49 of the web 47, protruding freely from this slot 48, is angled for attaching of the support ledge 46 and the edge region 49 abuts closely to the outside of the burner plate 17.

A downwardly directed flange 50, disposed parallel to the flange 45, is staggered due to an offset of the support ledge 46, and the flange 50 provides a support in individual recesses for the three cooling rods 2 and, in fact again, at a uniform distance from the wall of the burner pipe 1.

This support ledge 46 further carries also individually punched flaps 51. The front faces of the individual cooling rods 2 rest at the punched flaps 51 for the purpose of providing an axial position of fixation.

FIGS. 58 to 60 illustrate a burner plate 17 in a vertical section and in a horizontal section. According to these figures, the burner plate 17 is provided with an edge flange 52 inwardly directed against the burner chamber at its upper horizontal edge. The inwardly directed edge flange 52 grips over the upper edge of an insulating plate 53, made out of a ceramic or mineral and thermally stable material, at the inner side of the burner plate 17. The directed edge flange 52 is also penetrated by a bolt 54, which bolt 54 fixes the insulating plate 53 in this edge region. The burner plate 17 is demountably attached to a boiler constructed of sections, where the sections are designated with the numeral 55. The profile of these sections 55 follows a broken line and the slot, between the burner plate 17 and the edge of the members 55, in this way varying in its width, is filled with a soft insulating material, which soft insulating material is designated as 56.

The support 57 serves both for the attachment of the insulating plate 53 as well as for providing a support of the cooling rods 2. The cooling rods 2 extend parallel to the burner pipe 1, not shown here, and the burner pipe 1 can be attached to the burner plate 17.

The support 57 comprises a profile which, in turn, includes a flange 48 attached by rivets or by welding at the burner plate 17 and resting at the inner wall of the burner plate 17; a web 59 projecting from the burner plate 17 by an amount of the thickness of the insulating plate 53; an edge flange 60 gripping around the lower edge of the insulating plate 53 and directed upwardly and, at least a flange 61 directed downwardly and serving to provide a support for the cooling rods 2. A tongue 62, also directed downwardly and in each case coordinated to the front side of the cooling rod 2, serves to provide an axial fixation of the cooling rod 2 in a desired position.

The insulating plate 53 can be provided, in its edge region, with a step-shaped shoulder 63, as is shown in FIGS. 58 and 60. A part of the casing, for example a section of the boiler 55, can engage into the step-shaped shoulder in a form-locking way.

Figure 61:
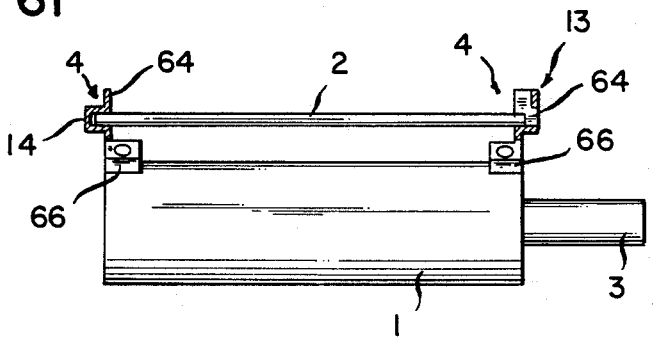
Figure 47:
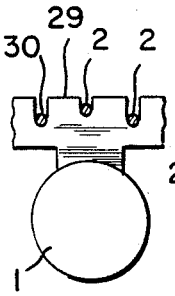
Figure 48:
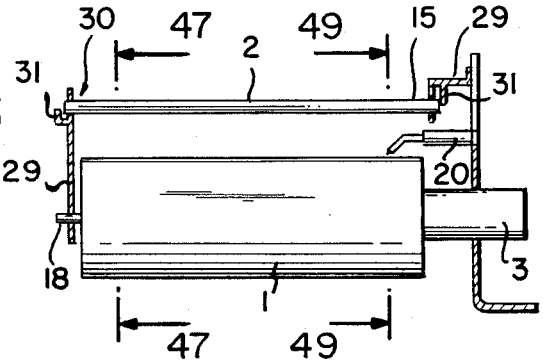
Figure 49:
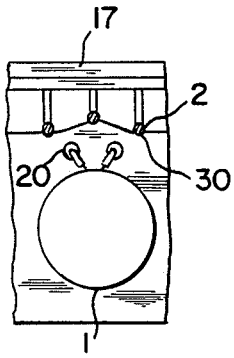
Figure 50:
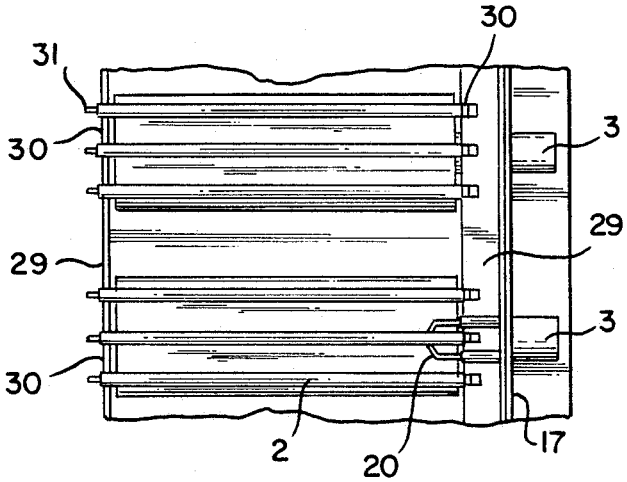

FIG. 61 illustrates initially in an elevational view or, respectively, in a section, the preferred principle regarding the support of the cooling rods. This preferred principle is a support where the one end of each rod is radially supported, but supported such that an axial shifting is possible, whereas the second end of the cooling rod is supported radially movable but fixed in an axial position.

The supports 4 of the embodiments according to FIGS. 61 to 67 are attached at the wall of the burner pipe 1 itself and they are provided with an upwardly projecting arm 64 and a curved arm 66. The curved arm 66 rests at the burner pipe wall and is possibly adapted to the shape of this wall. These supports can comprise angle-shaped ceramic form pieces and can, for example, be rivetted to the wall of the burner pipe as illustrated in FIGS. 61 to 63.

According to the embodiment illustrated in FIGS. 64 and 65, the disk-shaped supports 4 are provided with upwardly open grooves 65 for inserting and for lockingly retaining the cooling rods 2. These grooves get narrower in their direction toward their base in order to clamp the rods this way and in order to provide in addition a positional fixation in axial direction.

The disk-shaped base 10 of such supports 2 can be attached at the wall of the pipe with an arm 66 curved corresponding to the curvature of the wall.

In addition, a single-piece unit 9 comprising cooling rods 2 can be attached at the burner pipe 1 with the aid of such angle arms 66, according to FIGS. 66 and 67.

In addition, the attachment of a disk-shaped base 10 of the supports 4 is possible with the aid of two edge webs 67, disposed downwardly on two sides and tangenting the flanks of the burner pipe 1, as shown in FIGS. 68 to 72.

In addition, a tensioning element 68 is provided according to FIGS. 71 and 72, similar as in the embodiments according to FIGS. 52 and 53. The tensioning element serves at least as a transporting security and the tensioning element retains the cooling rods 2 in their supports 4. Such tensioning elements 68 can be produced from wire or band and are preferably made of an elastic material.

Supports 4, comprising at least one loop surrounding at least over a certain area a cooling rod 2, are formed of band or wire as shown in FIGS. 73 to 78, similar to the illustrations of FIGS. 18 and 19.

Figure 73:
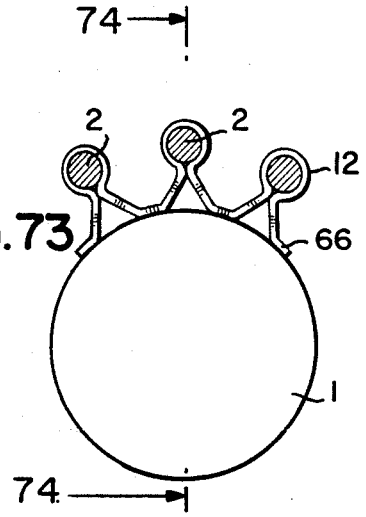
Figure 74:
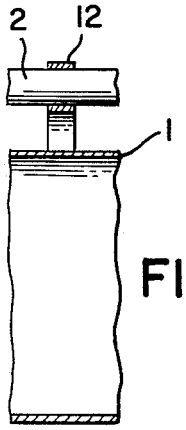

The band structure 12, according to FIG. 73, totally surrounds the cooling rods 2, that is, circumferentially closing, and forms double-wall support webs in each case below these cooling rods 2.

Figure 75:
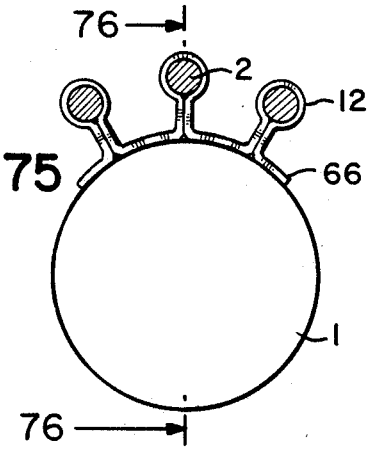
Figure 76:
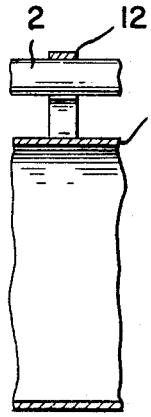
Figure 77:
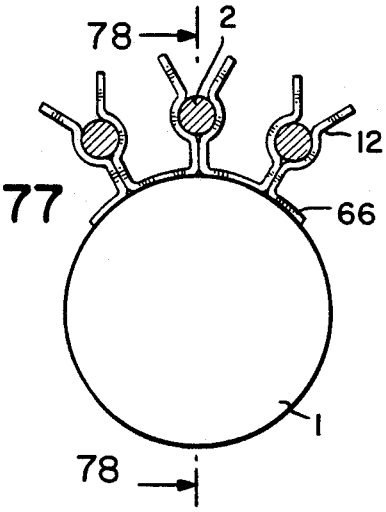
Figure 78:
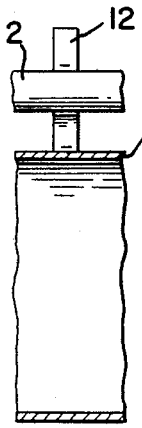

The band structure 12 forms spread stand-legs below the cooling rods according to FIG. 75. The band structure 12 is disposed in each case only at the flank regions of the cooling rods 2 according to FIG. 77. The band structure 12 forms above these flank regions, with diverging wings, open receptacles suitable for insertion of the cooling rods.

All these band structure 12 are provided with angle arms 66. The curvature of the angle arms 66 corresponds to the curvature of the wall of the burner pipe 1. The band structures 12 are attached to this wall of the burner pipe 1 with these angle arms 66.

In a simple case, the supports of the cooling rods 2 can be anchored in prefabricated anchoring members of the wall of the burner pipe 1.

For example, bore holes can be provided in this pipe wall, into which the supports themselves are inserted or, alternatively, support elements can be inserted serving for the attachment of the supports, in order to be solidly attached with a fitted seat, friction-engagingly, or by a screwing mechanism. Advantageously, such bores are provided as threaded bores. Supports, themselves provided with threads or support elements of such supports with threads, can be screwed into the threaded bores.

A variant is illustrated in FIGS. 79 to 80. According to the variant, a threaded nut 69 is attached at the inner side of the wall of the burner pipe 1 and disposed coaxially with a bore of this wall. For example, the attachment of the threaded nut 69 is by welding. Such a threaded nut 69 could be attached, within the scope of the invention, also at the outside of the pipe wall.

In addition, a bushing 70, provided with an inner thread, a hollow rivet or the like element, which passes through the pipe wall, can be employed as an anchoring member instead of such a threaded nut 69 within the scope of the invention, as is illustrated in FIGS. 81 and 82. Possibly, such a threaded bushing 70 can be provided with an extension 71, which is welded to the pipe wall penetrated by the bushing.

The region of the fuel exit openings, that is, the upper region of the pipe wall, is designated with numeral 72 in FIGS. 83 to 85.

A support 73 for a cooling rod can be screwed with the aid of a threaded bolt 74 in the inner thread of such anchoring members 70 or, respectively, 71. The radial set point distance of the support 73 from the pipe wall can be very simply determined and fixed by selecting the screwing-in depth, according to FIG. 84.

As mentioned, the bolt 74 of the supports 73 can also only be inserted into bores without threads of the pipe wall in order to be attached by a fitted seat via the adhesion and frictional engagement.

Furthermore, shape and/or friction-locking attachment of the supports 4 is conceivable as illustrated in FIG. 85. Support elements 75, springingly locking behind the pipe wall, can serve as support elements of supports 4 in the case of a shape and/or friction locking attachment.

In case of a sufficiently dense disposition of the anchoring members in the region 72 of the pipe wall, there can be coordinated advantageously the supports 4 to the fuel exit openings in an arbitrary changeable number, disposition, and distance. For example, FIG. 86 illustrates a coordination of such anchoring members 71 to the fuel exit openings 76 of a burner pipe 1 disposed in groups of slots and holes.

Embodiments of supports 4, which are attached to pipe clamps 77, are illustrated in FIGS. 87 to 98. the supports 4 can be attached by clamping at the pipe with the pipe clamps 77. Such a circular pipe of clamp 77 rests immediately at the outside of the pipe wall of the burner pipe. The circular pipe clamp 77 ends at its bottom side in two arms 78 disposed parallel and opposite to each other under leaving of a distance 79. The bores of the arms 78 are flush-aligned in the axis 80 and the arms 78 can be pressed against each other with the aid of a bolt, not illustrated, in order to clamp open the pipe clamp 77 at the burner pipe wall.

The support 4 is welded at the upper side of the pipe clamp 77. The support 4 comprises a disk 10 with two support arms. The support arms in turn support angled arms 64 resting at the burner pipe wall. The two support arms delimit a recess 11 through which the flames of the burner can propagate from one side to the other of the support 4, in case the burner is ignited.

Figure 87:
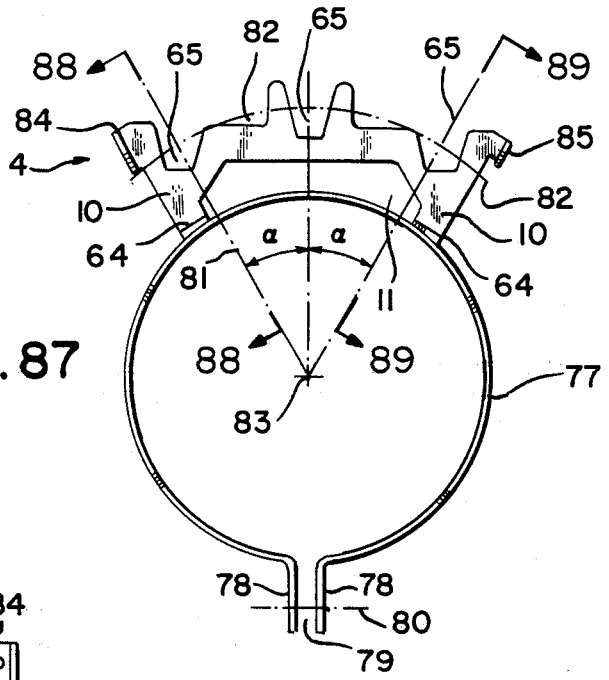
Figure 96:
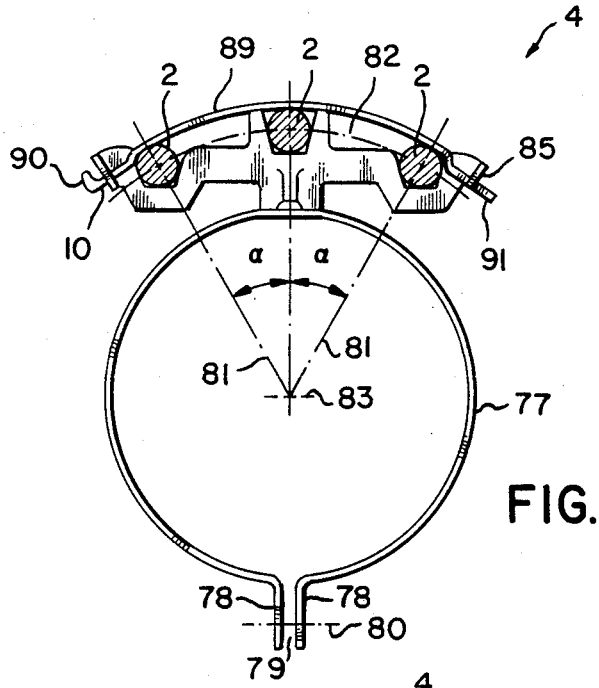

Three downwardly narrowing grooves 65 are disposed in the upper edge of the disk 10 of the support 4, according to FIGS. 87 and 96. The center points of the narrowing grooves 65 rest on a partial circle 82, where the partial circle 82 is disposed concentrically relative to the axis 83 of the burner pipe 1. The radii defined by the centers of the grooves 65 enclose a center angle of a size of about 27 degrees.

Figure 88:
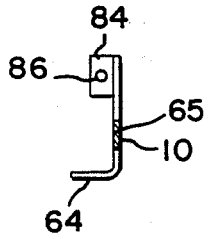
Figure 89:
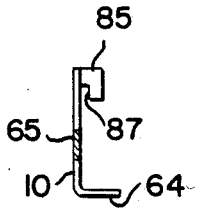

Sections guided along the radii 81 of the two outer grooves 65 are shown in FIGS. 88 and 89. FIGS. 88 and 89 show that the support 4 is provided, at its two side edges, with attachment members shaped as bends 84 or, respectively, 85. The bend 84 is provided with a hole 86, and the other bend 85 with a undercut 87.

The end of a bow 89 can be lead through the hole 86 according to FIG. 96. The other end of the bow can be anchored in the undercut 87 and the bow can retain the cooling rods 2 in the grooves 65 and can press the cooling rods against the floor of the narrowing grooves such that the cooling rods are also in axial direction attached in the narrowing grooves.

Figure 90:
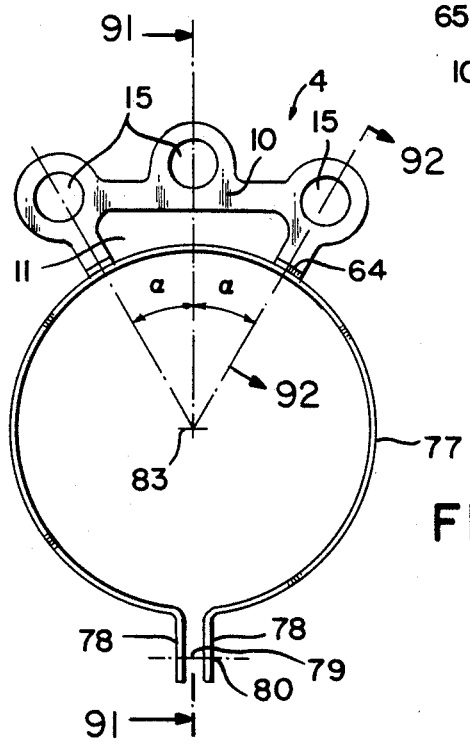
Figure 97:
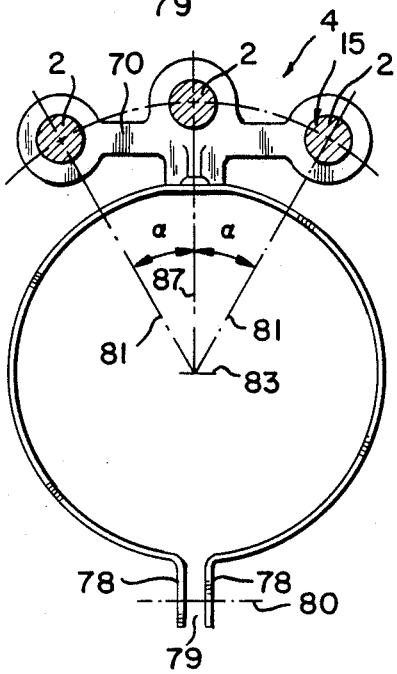

The coordinated second support 4 is illustrated in FIGS. 90 and 97. The coordinated second support is like the members serving for the attachment at the burner pipe 1, according to FIGS. 89 and 96. The support 4 of this pipe clamp 77, however, is provided with three round holes 15 for supporting the cooling rods 2, where the cooling rods can be slidingly supported and supported and supported radially in the round holes 15.

Cross-sections of the support 4, according to FIG. 90 in the planes SCI—XCI and XCII—XCII, are illustrated in FIGS. 91 and 92. FIGS. 93 to 95 represent a variant of the embodiments according to which the supports 4 are formed with a cross-stiffening element 88 and are formed as a single piece with the pipe clamp 77.

Figure 98:
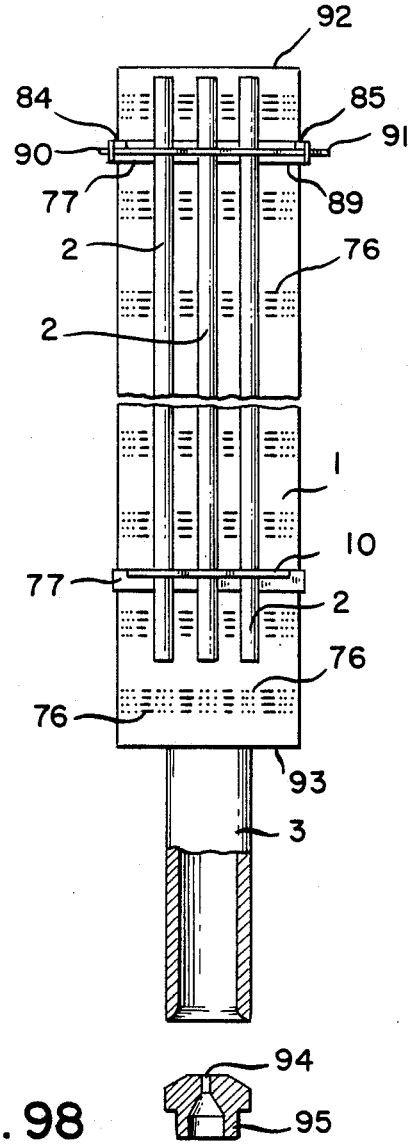

The disposition of the pipe clamps 77 at the burner pipe 1 is illustrated in FIG. 98. FIG. 98 shows a single burner pipe in a plan view. This burner pipe is closed at its front side 92 and a fuel feed line 3 is provided at the opposite end 93. A gas feed line 95 blows gas mixed with air into a nozzle 94 into the fuel feed line 3.

Groups of holes and groups of slots are alternatingly disposed as fuel outlet openings. The burner rods 2 run such that they cover only regions of holes but never regions of slot groups. If larger and smaller recesses of a different configuration are provided as fuel exit openings 76, then the cooling rods are to be dimensioned or disposed such that they cover or, respectively, surround in each case the round openings.

It can also be recognized from FIG. 98 that in each case two different supports 4 are provided of which supports the one, which is closer to the front face 92, is formed according to FIG. 87 and clamps the cooling rods 2, whereas, in contrast, the second support 4, according to FIG. 99, slidingly supports the cooling rod 2 in order to provide a balancing of length changes based on different extension coefficients of the material of the cooling rods or, respectively, of the burner pipe 1.

Five groups of holes are provided over the upper side of the burner pipe 1 according to the embodiment illustrated and each of the three inwardly disposed hole groups is coordinated to a cooling rod. In the case that more hole groups are present, then the number of the cooling rods can be correspondingly increased.

Finally, the invention also relates to the cooling rods for the invention burners.

Such cooling rods 2 can exhibit, within the frame of the invention, a full profile. Alternatively, they can also be formed hollow, as is illustrated in FIG. 99. In fact, both circular as well as oval-shaped cross-sections can be provided for the cooling rods, as can be recognized from FIG. 100 or, respectively, 101.

Various provisions can be made for attaching such cooling rods 2 in their supports 4 and to provide for their axial and/or radial securing in position within the scope of the invention. For example, the individual cooling rod can carry, at least at one of its ends, a peg 96, according to FIG. 102. Furthermore, the individual cooling rod can be provided with one circularly surrounding groove 97 disposed at at least one of its ends, as shown in FIG. 103. Also, as shown in FIG. 104, two or more circularly surrounding grooves 97 can be provided at an individual cooling rod. Of course, also different cross-sectional changes, such as collars, sleeves, shoulders, recesses, and the like, can be provided instead of the grooves 97. For example, a head 98 according to FIG. 105 can be employed. Finally, the rod according to FIG. 106 can exhibit an axial recess 99 at at least one of its ends. The rod can be placed with the recess 99 on a pin or the like belonging to the support 4, or the rod can form, at least at one of its ends, a cone 100 according to FIG. 107.

Cooling rods, where the side toward the burner pipe 1 is cylindrically formed and where the remaining part is of prismatic shape, are shown in FIG. 108. A cooling rod 2 with a U-shaped cross-section surrounding the hollow space 101 is shown in FIG. 109. A cooling rod 2 with a cross-section according to FIG. 108 is shown in FIG. 110. A cooling rod 2 with a trapezoidal cross-section is illustrated in FIG. 111, where the narrow side of the trapezoidal cross-section is turned toward the wall of the burner pipe 1.

Figure 113:
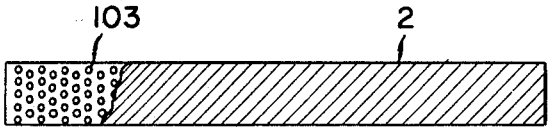
Figure 112:
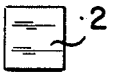

A further variant of the cooling rods 2 is illustrated in FIGS. 112 and 113. This rod, for example, exhibits a prismatic shape and is provided at its upper surface with a plurality of holes 103. Other profiles can also be used instead of such a profile. For example, a plurality of warts or such unevennesses can be provided.

The cooling rods 2 can also be formed, depending on the disposition of the fuel exit openings, with a varying profile as shown in FIGS. 114 to 117. Such a change in cross-section is illustrated initially in FIG. 114. According to FIG. 114, smaller cross-sectional regions can alternatingly change over into regions or large cross-section.

The thicker regions of the rod can be sub-divided into ribs 106 according to FIGS. 115 to 117. The thicker regions of the rod can be represented by local bulges 107 or by cylindrical sleeves 108.

It is essential that there, where large fuel exit openings are present, the cross-section of the cooling rod 2 is relatively small, however that there, where no or only relatively small exit openings are provided, a large rod cross-section is employed.

Figure 118:
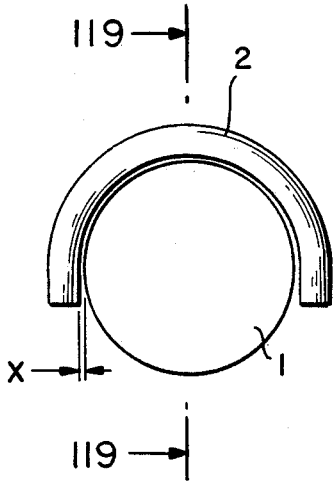
Figure 119:
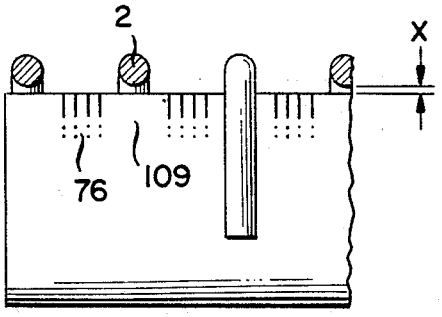
Figure 123:
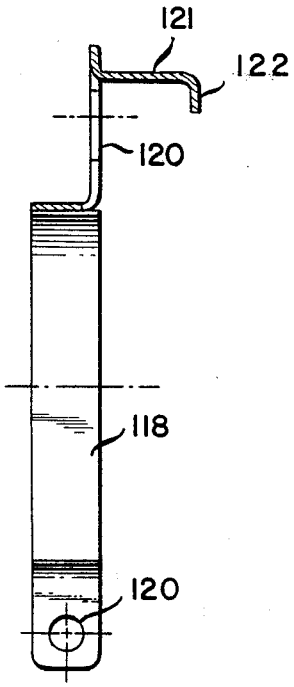
Figure 124:
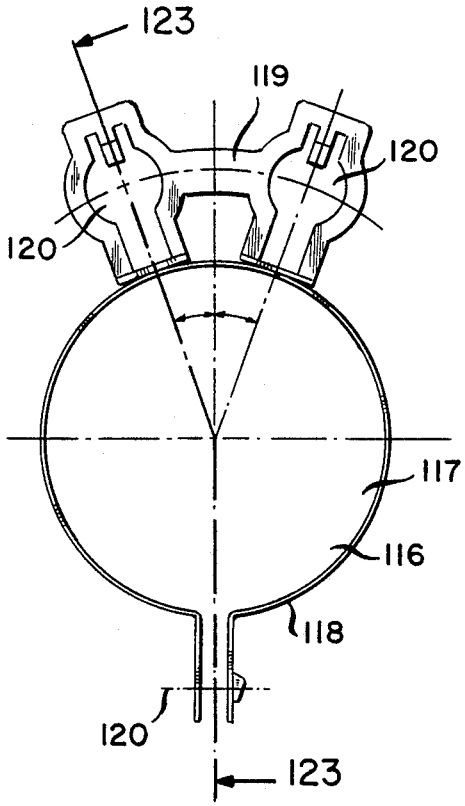

Finally, a burner with a burner pipe 1 is shown in FIGS. 118 and 119. The fuel outlet openings 76 of the burner pipe 1 are formed again in part as slots, in part as holes, as shown in FIGS. 118 and 119. These fuel exit openings 76 are arranged in groups in the longitudinal direction of the burner pipe 1. Free regions 109 without such openings are disposed between the groups.

A cooling rod 2, adapted to the curvature of the burner pipe and curved about semi-circular and running crosswise to the axis of the burner pipe 1, is coordinated to each of these free regions 109.

The invention can be modified in its details in many ways. Even though the illustrated and explained embodiments refer to gas burners, the invention can also be applied in modified shape for burners which are operated with other fuels, such as oil. Furthermore, the invention is not limited to atmospheric gas burners but can also be applied to blower burners with a closed burner chamber. In the case of blower burners, the burner pipe only needs to exhibit a different shape as a flame pipe. The blower could be disposed on the feed side or on the exhaust side.

FIG. 119

A plate 110 is illustrated in FIG. 20, which represents a support element for all ceramic rods coordinated to the individual burner pipes. Recesses 111 are present for adaptation to the burner pipes. The recesses 111 rest with their outer periphery at the outer circumference of the burner pipes. The plate 110 is provided with attachment holes 112 and the plate 110 is attached to a burner plate by way of the attachment holes 112. The burner plate in turn protects the burner space against the outer atmosphere. Two recesses 111 for two burner pipes can be provided in the region of the plate 110, as can be seen in the embodiment illustrated. Alternatively, more recesses for a correspondingly larger number of burner pipes can be present.

A pilot burner is coordinated to one of the burner pipes. A further opening 113 is provided in the region of the recess 111. The opening 113 is rectangular and is canted out of the sheet-metal flap 114. The canting is in fact such that the sheet-metal flap 114 runs parallel at the bottom side of the opening 113 and at a distance to the corresponding burner pipe. This flap 114 serves to shield the pilot flame of the pilot burner against rising secondary air out of the region of the burner pipe. The pilot burner reaches through the opening 113. The pilot burner serves to ignite the gas-air mixture of the burner pipes at this burner pipe. Thus, it is not possible to position several ceramic rods in this region. Only one single ceramic rod can be supported via an opening 115. The two other ceramic rods are supported with a separate support which can be recognized from the view of FIG. 125. Here, the burner pipe 116, which is supported by the inner space 117 of a clamp 118, is provided with a support sheet-metal 119, which is welded to the clamp. The clamp is clamped with a flange connection 120 at the outer circumference of the burner pipe and, in fact, at the lower side of the burner pipe. The support sheet-metal 119 exhibits two recesses 120, through which the remaining two ceramic rods are inserted. The openings are generated by punching a flap 121, compare FIG. 4, which flap 121 is provided with a section 122 disposed at an angle.

The ceramic rod grips through the generated opening 120, which forms a side limitation of the longitudinal play for the ceramic rod. Thus, the ceramic rod can freely expand and contract, but it cannot fall out of the support.

Three openings 123 are present in all other burner pipes not provided with a pilot burner. The three openings 123 comprise equally an outwardly projecting flap 121 with an angle section 122.

The upper side 124 of the plate 110 is provided with a shoulder 125. An insulation is supported on the shoulder 125.

We claim:

1. Burner, in particular an atmospheric pre-mix gas burner, with at least one longitudinally extended burner pipe disposed inside a burner chamber, where the pipe wall of the burner pipe is provided with group-wise disposed bundles of fuel exit openings for a fuel to be fed into the interior of the burner pipe, and in particular for a fuel-air mixture at the upper side disposed toward the interior of the burner chamber, characterized in that at least one cooling rod, consisting of a thermally stable and thermally conducting material, extends inside the burner chamber at a distance (x) above the upper side of the pipe wall at least over free regions remaining between the bundles of fuel exit openings of the burner pipe, wherein the cooling rod has an offset end position spaced further from the burner pipe, where the cooling rod (2) serves to cool the core region of the flames formed at the fuel exit openings and comprising a pilot element disposed between the offset end position of the cooling rod and the burner pipe, said pilot being directed with its flame toward fuel exit openings of the burner pipe.

2. Burner according to claim 1, characterized in that several cooling rods (2) disposed at distances next to each other exhibit a distance (x) of uniform size from the upper side (7) of the burner pipe (1), where the upper side (7) is provided with fuel exit openings.

3. Burner according to claim 1, characterized in that the cooling rods (2) are running in longitudinal direction of the individual burner pipe (1) above the upper side (7) of the individual burner pipe, where the cooling rods are disposed preferably at a uniform distance (x) from the axis of the burner pipe (1).

4. Burner according to claim 3, characterized in that a support (4) is for example formed like a disk and is provided with recesses, closed around the circumference, such as, for example, holes (15), or grooves (65) or niches (13) open in upward direction, for providing passage and for the locking support of the cooling rods (2).

5. Burner according to claim 3, characterized in that a, for example, disk-shaped support (4) is provided with at least a recess dimensioned according to the cross-section of a cooling rod (2), such as, for example, a sack hole (14) for providing a locking connection with such a cooling rod (2).

6. Burner according to claim 3, characterized in that several cooling rods (2) of the same length represent a single-piece unit (9), which can be inserted between two supports (4) joined on two sides to the front face of the burner pipe (1).

7. Burner, in particular an atmospheric pre-mix gas burner, with at least one longitudinally extended burner pipe disposed inside a burner chamber, where the pipe wall of the burner pipe is provided with group-wise disposed bundles of fuel exit openings for a fuel to be fed into the interior of the burner pipe, and in particular for a fuel-air mixture at the upper side disposed toward the interior of the burner chamber, characterized in that at least one cooling rod, consisting of a thermally stable and thermally conducting material, extends inside the burner chamber at a distance (x) above the upper side of the pipe wall at least over free regions remaining between the bundles of fuel exit openings of the burner pipe, where the cooling rod (2) serves to cool the core region of the flames formed at the fuel exit openings, wherein the cooling rods (2) are running in longitudinal direction of the individual burner pipe (1) above the upper side (7) of the individual burner pipe, where the cooling rods are disposed preferably at a uniform distance (x) from the axis of the burner pipe (1);

further comprising a pilot element (20) directed against the fuel exit openings of the burner pipe (1);

a preferably disk-shaped support (4) forming a recess (11) for the passage of the pilot element (20) directed against the fuel exit openings of the burner pipe (1).

8. Burner according to claim 1, wherein the burner pipe (1) has two front faces; characterized in that the ends of the cooling rods (2) directed to the pilot element (20) are upwardly offset at one of the front faces of the burner pipe (1) for placing pilot element (20) into a hollow space (16) formed below the cooling rods (2).

9. Burner according to claim 1 further comprising two supports (4) for the cooling rods;

a support for the pilot element;

characterized in that the support of the pilot element (20) forms one of the two supports (4) of the cooling rods (2) and where the support is, for example, a burner plate (17).

10. Burner according to claim 1 wherein the cooling rod is provided with a full profile.

11. Cooling rod for a burner according to claim 1, characterized in that it is provided with a hollow profile.

12. Cooling rod according to claim 10, characterized in that its surface is arranged in a plurality of holes, warts, or such unevennesses.

13. Atmospheric gas burner with at least one longitudinally extended burner pipe, disposed in a burner chamber, where the upper side of the wall of the burner pipe exhibits mixture exit openings for a gas-air mixture fed to the burner pipe, wherein at least one support for at least one cooling rod is associated to the burner pipe, preferably made out of a metallic material, where the cooling rod, preferably made out of a ceramic material, runs essentially parallel to the axis of the burner pipe and at a distance of the pipe wall, characterized in that a pilot is provided directed toward the mixture exit openings and in that the support (4) is provided with at least one flat support part (5, 9, 12), extending in a plane perpendicular to the axes of the cooling rod (2) and of the burner pipe (1), said support part having a recess opening for said pilot having a flame directed in the area between a cooling rod and the burner pipe.

14. An atmospheric pre-mix gas burner comprising a burner chamber;

at least one longitudinally extended burner pipe having a pipe wall, said burner pipe being disposed in the burner chamber, where the pipe wall of the burner pipe is provided with bundles of fuel exit openings for a fuel to be fed into the interior of the burner pipe, and in particular for a fuel-air mixture at the upper side disposed toward the interior of the burner chamber;

at least one cooling rod, consisting of a thermally stable and thermally conducting material, extending inside of the burner chamber at a distance (x) above the upper side of the pipe wall at least over free regions remaining between the bundles of fuel exit openings of the burner pipe, where the cooling rod serves to cool the core region of the flames formed at the fuel exit openings and wherein the cooling rod is bent for furnishing a space for a pilot element;

a pilot element placed in the area between cooling rod and burner pipe near an end of the burner pipe, said pilot element directed with its flame against fuel exit openings of the burner pipe.

15. Burner according to claim 2, characterized in that all cooling rods (2) supported in a joint support (4) exhibit the same uniform distance (x) from the upper side of the wall of the burner pipe (1).

16. Burner according to claim 1 further comprising a joint support for the cooling rods, characterized in that all cooling rods (2) supported in the joint support (4) exhibit the same uniform distance (x) from the upper side of the wall of the burner pipe (1).

17. Burner according to claim 1 further comprising two supports (4) for the burner pipe (1), characterized in that at least one of the supports (4) is formed as a disk (5) with a circumference adapted to the cross-section of the burner pipe (1), where the disk (5) can be attached on the front of the burner pipe (1) and be inserted into an open front side of the burner pipe (1) closing the burner pipe.

18. A burner comprising a burner chamber;

a longitudinally extending burner pipe;

a first support disk disposed at a first end of the burner pipe;

a second support disk disposed at a second end of the burner pipe;

a fuel feed pipe supported by the second support disk and passing from the outside into the inside of the chamber; said burner pipe having a pipe wall and disposed in the burner chamber, where the pipe wall of the burner pipe is provided with group-wise disposed fuel exit openings at the upper side disposed toward the interior of the burner chamber for a fuel to be fed into the interior of the burner pipe via the fuel feed pipe;

a pilot element;

at least one cooling rod made of a thermally stable and thermally conducting material and extending with a main portion inside the burner chamber at a defined uniform distance from the axis of the burner above the upper side of the pipe wall at least over free regions remaining between the bundles of fuel exit openings of the burner pipe, and having an offset end portion spaced further from the burner axis where the cooling rod serves to cool the core region of the flames formed at the fuel exit openings and where the offset end position provides space for allowing a positioning of the pilot element having a pilot flame directed in the area of one of the fuel exit openings.

19. The burner according to claim 18 wherein the offset portion of the cooling rod is disposed in the area of the cooling rod near the second support disk.

20. The burner according to claim 18 further comprising a feed pipe for the pilot extending through the second support disk with the pilot attached to the feed pipe for the pilot and disposed in the area of the offset portion of the cooling rod at a radial extension from the burner pipe less than the extension of the offset portion of the cooling rod.

21. The burner according to claim 18 wherein the first support disk and the second support disk are each provided with recesses closed around the circumference for providing a passage and for providing a locking support to the cooling rods.

22. The burner according to claim 18 wherein one of the support disks is provided with at least a recess dimensioned according to the cross-section of a cooling rod for providing a locking connection with such a cooling rod.

23. A burner comprising a burner chamber;

a burner pipe;

a first support disk disposed at a first end of the burner pipe;

a second support disk disposed at a second end of the burner pipe;

a fuel feed pipe supported by the second support disk and passing from the outside into the inside of the chamber;

at least one longitudinally extended burner pipe having a pipe wall and disposed in the burner chamber, where the pipe wall of the burner pipe is provided with group-wise disposed fuel exit openings at the upper side disposed toward the interior of the burner chamber for a fuel to be fed into the interior of the burner pipe via the fuel feed pipe;

at least one cooling rod made of a thermally stable and thermally conducting material and extending with a main portion inside the burner chamber at a defined uniform distance from the axis of the burner above the upper side of the pipe wall at least over free regions remaining between the bundles of fuel exit openings of the burner pipe, and having an offset end portion spaced further from the burner axis where the cooling rod serves to cool the core region of the flames formed at the fuel exit openings and where the offset end position provides space for allowing a positioning of a pilot element having a pilot flame directed in the area of one of the fuel exit openings;

wherein at least two cooling rods of equal length form a single-piece unit, which can be inserted between the first support disk and the second support disk, which are joined with respective sides to an end face of the burner pipe.

24. The burner according to claim 18 wherein a recess is formed in one of the support disks for allowing said pilot element to pass through, said pilot element being directed with its flame against the fuel exit openings of the burner pipe.

* * * * *